US010910737B2

(12) United States Patent
Wu et al.

(10) Patent No.: US 10,910,737 B2
(45) **Date of Patent: *Feb. 2, 2021**

(54) RAIL TERMINAL ASSEMBLING STRUCTURE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wei-Chi Chen, New Taipei (TW); Ming-Shan Tai, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 264 days.

This patent is subject to a terminal disclaimer.

(21) Appl. No.: 16/018,322

(22) Filed: Jun. 26, 2018

(65) Prior Publication Data

US 2018/0301825 A1 Oct. 18, 2018

Related U.S. Application Data

(63) Continuation-in-part of application No. 15/498,660, filed on Apr. 7, 2017, now Pat. No. 10,038,255.

(30) Foreign Application Priority Data

Sep. 13, 2016 (TW) ..... 105129737 A

(51) Int. Cl.
*H01R 4/48* (2006.01)
*H01R 9/24* (2006.01)

(52) U.S. Cl.
CPC ..... *H01R 4/4818* (2013.01); *H01R 9/2416* (2013.01); *H01R 4/4809* (2013.01); *H01R 4/4836* (2013.01)

(58) Field of Classification Search
CPC .. H01R 4/4845; H01R 4/4836; H01R 4/4827; H01R 43/26; H01R 9/2483;
(Continued)

(56) References Cited

U.S. PATENT DOCUMENTS 6,796,855 B2 * 9/2004 Fricke ..... H01R 4/4818 439/835
10,038,255 B2 * 7/2018 Wu ..... H01R 4/4818
(Continued)

*Primary Examiner* — Renee S Luebke
*Assistant Examiner* — Paul D Baillargeon
(74) *Attorney, Agent, or Firm* — Rosenberg, Klein & Lee

(57) ABSTRACT

A rail terminal assembling structure includes a protection member formed with an assembling passage defined by a contact side section, a connection side section and two lateral sections. The connection side section has a first locating section, an elastic locating section and a second locating section. An end section of a conductive plate extends into the assembling passage and securely attached to the contact side section. A metal leaf spring has a first section, a second section and an elastic bight section connected between the first and second sections. The first section has a first located section and an insertion section. When the first section extends into the assembling passage and the first section elastically pushes/presses the elastic locating section until the insertion section reaches the elastic locating section, the elastic locating section is elastically engaged with the insertion section.

32 Claims, 18 Drawing Sheets

(58) Field of Classification Search
CPC ..... H01R 9/2608; H01R 4/4854; H01R 4/48; H01R 4/4809; H01R 4/4818
USPC ..... 439/816, 759, 786, 386, 817, 834, 854, 439/855, 858, 843, 845, 846, 847
See application file for complete search history.

(56) References Cited

U.S. PATENT DOCUMENTS

| | | | | |
|---|---|---|---|---|
| 2016/0164196 | A1* | 6/2016 | Wu ..... | H01R 4/4818<br>439/816 |
| 2017/0012368 | A1* | 1/2017 | Aboulkassem ..... | H01R 4/4845 |

* cited by examiner

RAIL TERMINAL ASSEMBLING STRUCTURE

This application is a continuation-in-part application of U.S. patent application Ser. No. 15/498,660.

BACKGROUND OF THE INVENTION

1. Field of the Invention

The present invention relates generally to a rail terminal assembling structure, and more particularly to a rail terminal assembling structure, which is convenient to assemble and provides elastic engagement and multi-portion locating effect so as to enhance the connection effect between the metal leaf spring and the protection member.

2. Description of the Related Art

A conventional terminal structure has an insulation case and a metal component or a metal leaf spring enclosed in the insulation case. The metal leaf spring serves to press and electrically connect with a conductive wire plugged into the terminal. The terminals are arranged and latched on a grounding rail (or conductive rail) to establish a common grounding device of an electrical apparatus or a mechanical apparatus for conducting the residual voltage or static charge of the apparatus.

Some conventional terminal structures also employ protection members assembled with the metal leaf springs. For example, US 2017/0012368 A1 "push-in clamp retainer, push-in clamp assembly and electric connector element" and US 2016/0164196 A1 "conductive wire connection structure of rail-type electrical terminal" (as shown in FIGS. 24, 25 and 26) disclose conventional terminal structures.

As shown in FIGS. 24, 25 and 26, US 2016/0164196 A1 includes a conductive plate 7, a protection member 8 and a metal leaf spring 9, which are assembled with each other to form a conductive support structure A. An upright arm 72 is perpendicularly connected with each of two ends of the conductive plate 7 for assembling with the protection member 8, whereby the conductive plate 7 has a U-shaped cross section. In addition, a notch 71 is formed on one side of the conductive plate 7 beside each upright arm 72 near the middle section of the conductive plate 7. A shoulder section 73 is disposed on one side of a top end of the upright arm 72. The protection member 8 is fitted around the upright arm 72. The protection member 8 includes a subsidiary side 85, a first side 81, a second side 82, a third side 83 and a fourth side 84, which are sequentially perpendicularly connected with each other. An opening 86 is defined between the fourth side 84 and the subsidiary side 85, whereby the protection member 8 has a C-shaped cross section for receiving the metal leaf spring 9. At least the subsidiary side 85 serves to guide the metal leaf spring 9 to move in a fixed path. In addition, two notches 821, 841 are respectively formed beside the junctions between the third side 83 and the second and fourth sides 82, 84. The metal leaf spring 9 includes a first section 91 and a bent second section 92 connected with the first section 91. The first section 91 has a tail end 94.

The second section 92 has a head end 93. In addition, two lateral protrusion sections 941, 942 are respectively formed on two sides of the first section 91. An outward protruding finger section 95 is disposed on the tail end 94.

When assembled, the protection member 8 is fitted around the upright arm 72 of the conductive plate 7. At this time, the second side 82 and the subsidiary side 85 are respectively fitted on two lateral sides of the upright arm 72 and the finger section 95 of the metal leaf spring 9 is inserted into the notch 71 of the conductive plate 7. The first section 91 is attached to the inner face of the third side 83. Then, the first section 91 and the third side 83 are connected with each other by means of a welding point 80 (as shown in FIG. 25) or a fixing member 800 (as shown in FIG. 26) or any other suitable method. Under such circumstance, the second section 92 extends toward the upright arm 72 with the head end 93 restricted by the shoulder section 73 from moving outward. Therefore, the head end 93 permits the conductive wire to easily plug into the terminal, while hindering the conductive wire from being extracted out of the terminal in a reverse direction.

However, in practice, the above structure has the following shortcomings:

1. The finger section 95 of the metal leaf spring 9 is inserted into the notch 71 so as to connect and locate the metal leaf spring 9 on the conductive plate 7. Therefore, the upright arm 72 at the end of the conductive plate 7 must extend in a direction substantially in parallel to the first section 91. (In practice, the upright arm 72 is bent to be approximately normal to the conductive plate 7). Only in this case, the simple shoulder section 73 can be used to reasonably restrict the second section 92 (the head end 93) of the metal leaf spring 9 to one-way elastically move toward the conductive plate 7. Under such circumstance, the design of the conductive plate 7 is indirectly affected. That is, the two end sections of the conductive plate 7 must be such structured as to have the bent upright arms 72. This limits the plug-in angle and direction of the external conductive wire inserted into the terminal. The conductive wire must be inserted into the protection member 8 in a direction normal to the conductive plate 7. Moreover, the conductive wire on the outer lateral side of the conductive support A must be first bent upward and then reversely bent downward so that the conductive wire can be plugged into the protection member 8 to connect with the metal leaf spring 9. This not only leads to inconvenience in working (especially the conductive wire with larger diameter is uneasy to bend), but also will occupy more room.
2. The first side 81 of the protection member 8 contacts the outer side of the upright arm 72. The finger section 95 of the metal leaf spring 9 is inserted into the notch 71. The third side 83 is connected with the metal leaf spring 9 so as to connect with the conductive plate 7. Such connection structure fails to make the protection member 8 securely connected with the conductive plate 7 and located. As shown in FIG. 26, when the conductive wire applies an outward pulling force to the metal leaf spring 9, the first section 91 of the metal leaf spring 9 will bear a counterclockwise torque centered at the finger section 95. When the counterclockwise torque exceeds the frictional force between the finger section 95 and the notch 71, the protection member 8, the metal leaf spring 9 and the conductive plate 7 are very apt to loosen and detach from each other. This affects the reliability in assembling the conductive wire with the relevant terminal.

It is therefore tried by the applicant to provide a rail terminal assembling structure to solve the above shortcomings of the conventional rail terminal assembling structure.

SUMMARY OF THE INVENTION

It is therefore a primary object of the present invention to provide a rail terminal assembling structure including a protection member having a contact side section, a connection side section opposite to the contact side section and two lateral sections disposed between the connection side section and the contact side section. The contact side section, the connection side section and the lateral sections together define an assembling passage passing through the protection member. A first locating section and an elastic locating section are disposed on the connection side section. A second locating section is disposed at the other end distal from the first locating section. An end section of a conductive plate extends into the assembling passage and is securely attached to the contact side section. The rail terminal assembling structure further includes a metal leaf spring having a first section and a second section at two ends and an elastic bight section at the middle section. A first located section and an insertion section are disposed on the first section. When the first section extends into the assembling passage corresponding to the connection side section and the first section elastically pushes/presses the elastic locating section until the insertion section reaches the elastic locating section, the elastic locating section is elastically engaged into the insertion section and cooperates with the second locating section to secure the second located section of the first section of the metal leaf spring. Accordingly, the first section of the metal leaf spring and the connection side section can form a multi-portion locating system. When an operator plugs the conductive wire into and/or extracts the conductive wire out of the terminal, the pulling force (or so-called external action force) of the operator is prevented from making the metal leaf spring loosen or detach from the protection member and/or the metal leaf spring can be directly securely connected on the protection member. The protection member is simply connected with one end of the conductive plate so that it is no more necessary to interconnect the conductive plate and the metal leaf spring. In this case, the protection member can be designed and characterized in that the protection member can be bent by different inclination angles relative to the conductive plate. Therefore, the external conductive wire can be plugged into the terminal and connected therewith by different angles. Accordingly, the entire layout of the rail terminal assembling structure is simplified and the requirement for ambient space is reduced.

In the above rail terminal assembling structure, the first section of the U-shaped metal leaf spring is connected with the inner surface of the preset connection side section of the protection member, whereby the first section of the metal leaf spring is respectively securely connected with the front and rear sides of the contact portion of the connection side section and the end section of the second section of the metal leaf spring abuts against the conductive plate. When an operator plugs the conductive wire into and/or extracts the conductive wire out of the terminal, the metal leaf spring (or the first section) will displace in response to the pulling force (or so-called external action force) of the operator. The maximum displacement amount is limited within a movable range (or movable distance) together defined by the assembling structure of the elastic locating section and the insertion section and the second locating section and the second located section. Accordingly, a connection effect without easy loosening is set up between the protection member, the metal leaf spring and the conductive plate.

The present invention can be best understood through the following description and accompanying drawings, wherein:

DETAILED DESCRIPTION OF THE PREFERRED EMBODIMENTS

Figure 1:
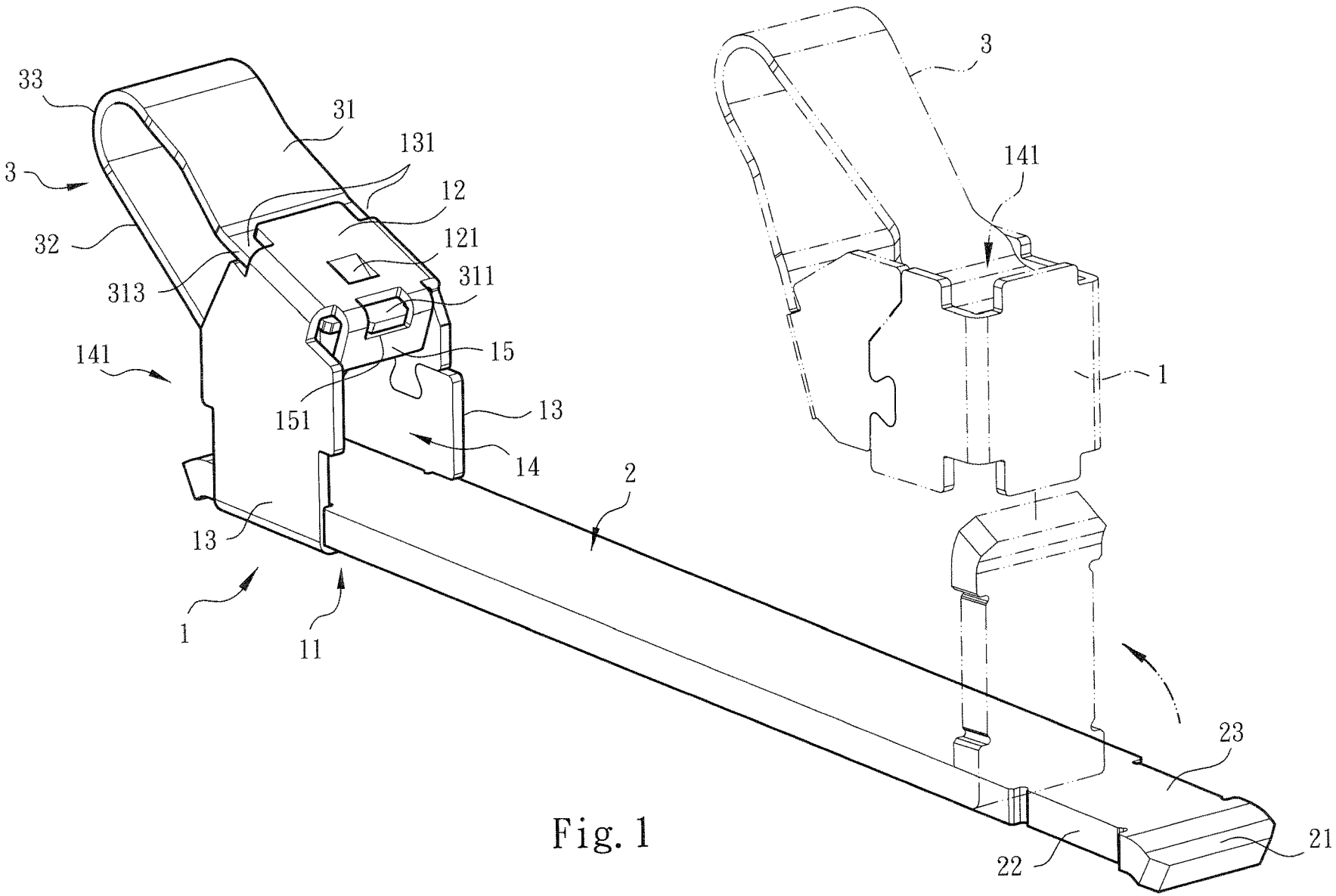
FIG. 1 is a perspective assembled view of a first embodiment of the present invention.
Figure 2:
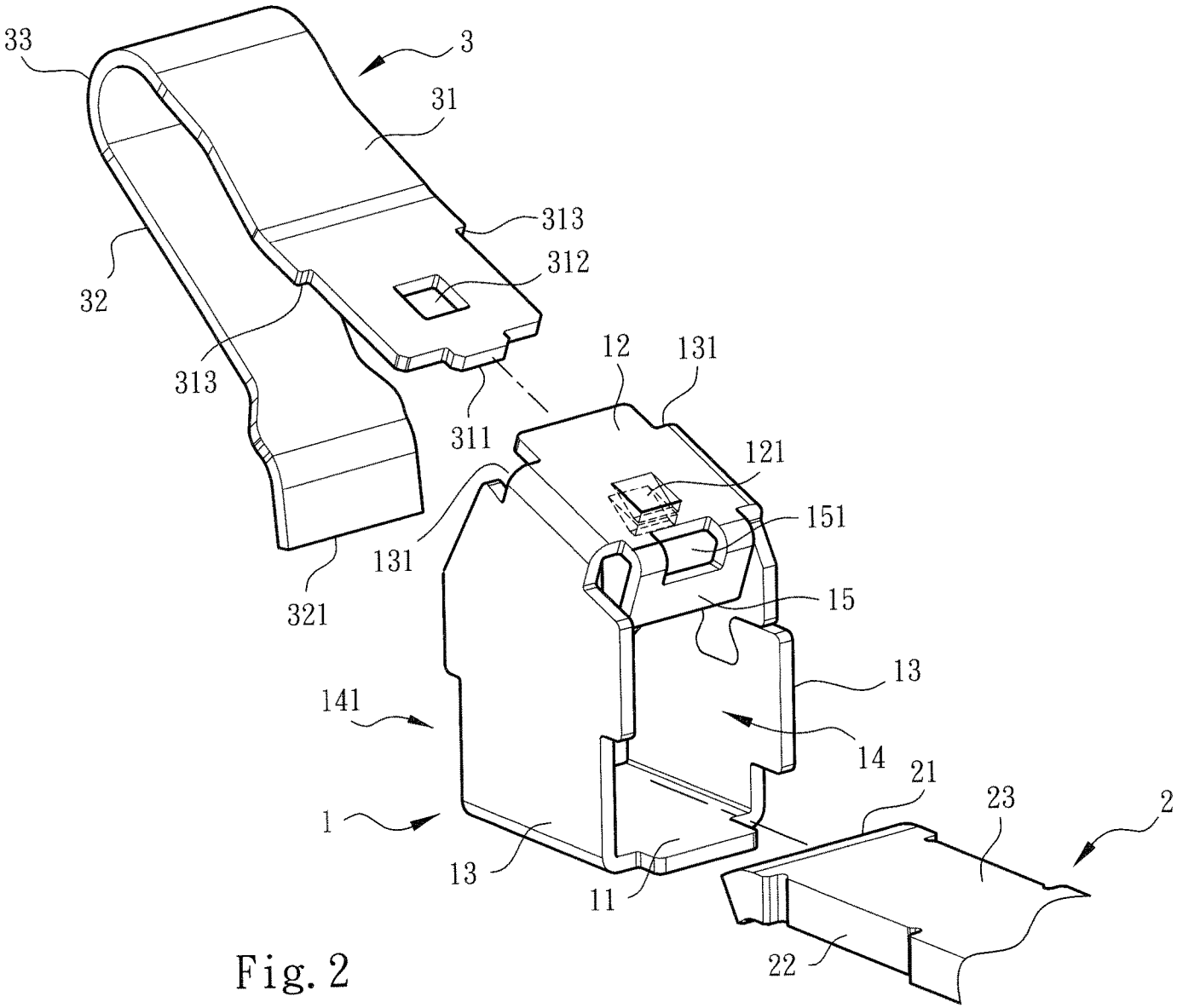
FIG. 2 is a perspective exploded view of the first embodiment of the present invention.

Please refer to FIGS. 1 to 4. According to a first embodiment, the rail terminal assembling structure of the present invention includes a protection member 1, a conductive plate 2 and a metal leaf spring 3. The protection member 1 has a contact side section 11 and a connection side section 12 opposite to each other. Two lateral sections 13 are respectively disposed on two sides of the connection side section 12. The lateral sections 13 extend from the two sides of the connection side section 12 to connect with two sides of the contact side section 11 so as to define an assembling passage 14 passing through the protection member 1. One end of the assembling passage 14 is a wire inlet 141. At the junction between the connection side section 12 and each of the two lateral sections 13, the wire inlet 141 is formed with a first locating section 131, (such as a lateral notch). In addition, a second locating section 15 is disposed at one end of the protection member 1 distal from the first locating sections 131. Moreover, at least one elastic locating section 121 is disposed on the connection side section 12. The elastic locating section 121 protrudes toward the assembling passage 14.

In a preferred embodiment, the second locating section 15 is a stop plate downward bent from an edge of the connection side section 12 toward the assembling passage 14. A perforation 151 is formed on one side of the stop plate proximal to the connection side section 12. The elastic locating section 121 is a protruding elastic locating tongue section formed by means of punching.

One end of the conductive plate 2 extends into the assembling passage 14 of the protection member 1 and is securely attached to an inner surface of the contact side section 11. In a preferred embodiment, the conductive plate 2 is respectively formed with lateral recesses 22 near two lateral sides of two end sections. The lateral recesses 22 can be fitted with the portions of the two lateral sections 13 of the protection member 1 in adjacency to the contact side section 11 with the conductive plate 2 attached to the inner side of the contact side section 11. Accordingly, the protection member 1 is located and hindered from moving in the axial direction of the conductive plate 2. The conductive plate 2 has an inner face 23 distal from the contact side section 11. In addition, two end sections of the conductive plate 2 are respectively formed with arched edges 21 bent and extending in a direction away from the assembling passage 14.

In practice, the conductive plate 2 not only can be secured by means of fitting the lateral recesses 22 with the protection member 1, but also can be securely connected with the protection member 1 by means of other suitable structures and manners. In this case, the conductive plate 2 can be better multidirectionally located.

The metal leaf spring 3 has a first section 31, a second section 32 and an elastic bight section 33 connected between the first and second sections 31, 32. Accordingly, the metal leaf spring 3 is a substantially U-shaped member. Two first located sections 313 are respectively disposed on two sides of the first section 31 of the metal leaf spring 3 near the middle of the first section 31, (such as outward expanded lateral protrusion sections). The first section 31 is formed with an insertion section 312 corresponding to the elastic locating section 121. The insertion section 312 has the structural form of a locating hole. It should be noted that the structural forms of the insertion section 312 and the elastic locating section 121 are exchangeable.

In a preferred embodiment, a second located section 311 (such as an end protrusion section) is disposed at a tail end of the first section 31 of the metal leaf spring 3. An end section 321 is disposed at a tail end of the second section 32. The end section 321 is arched and bent toward the contact side section 11.

When assembled, after the conductive plate 2 is connected with the protection member 1, the metal leaf spring 3 is extended into the assembling passage 14 with the first section 31 attached to the connection side section 12. The second locating section 15 (the stop plate) serves to stop the tail end of the first section 31 of the metal leaf spring 3. At this time, the second located section 311 is inserted into the perforation 151, while the elastic locating section 121 (elastic locating tongue section) extends into the insertion section 312. Also, the two first located sections 313 are respectively snugly securely engaged with the two first locating sections 131. Accordingly, the first section 31 of the metal leaf spring 3 is securely connected with the connection side section 12 of the protection member 1 to effectively locate the metal leaf spring 3. Also, the end section 321 of the second section 32 of the metal leaf spring 3 abuts against the inner face 23 of the conductive plate 2.

In use, the external conductive wire A extends into the assembling passage 14 from one side near the first locating section 131. At this time, the conductive wire A first pushes the second section 32 of the metal leaf spring 3 to elastically compress and deform the elastic bight section 33. After the conductive wire A passes through the end section 321, under the elastic restoring force of the elastic bight section 33, the end section 321 of the second section 32 cooperates with the inner face 23 of the conductive plate 2 to together hold the conductive wire A and electrically connect therewith. In the case that the conductive wire A is pulled by an external force, the conductive wire A will drive the second section 32 to move in reverse direction. Under such circumstance, the second section 32 will gradually move toward the conductive wire A and fasten the conductive wire A to effectively hinder the conductive wire A from being loosened and extracted out.

In the above structure of this embodiment, the first locating sections 131, the elastic locating section 121 (the elastic locating tongue section) and the perforation 151 of the second locating section 15 are connected with the first located sections 313, the insertion section 312 and the second located section 311. Accordingly, the first section 31 of the metal leaf spring 3 is located with the connection side section 12 of the protection member 1 at multiple portions.

Figure 4:
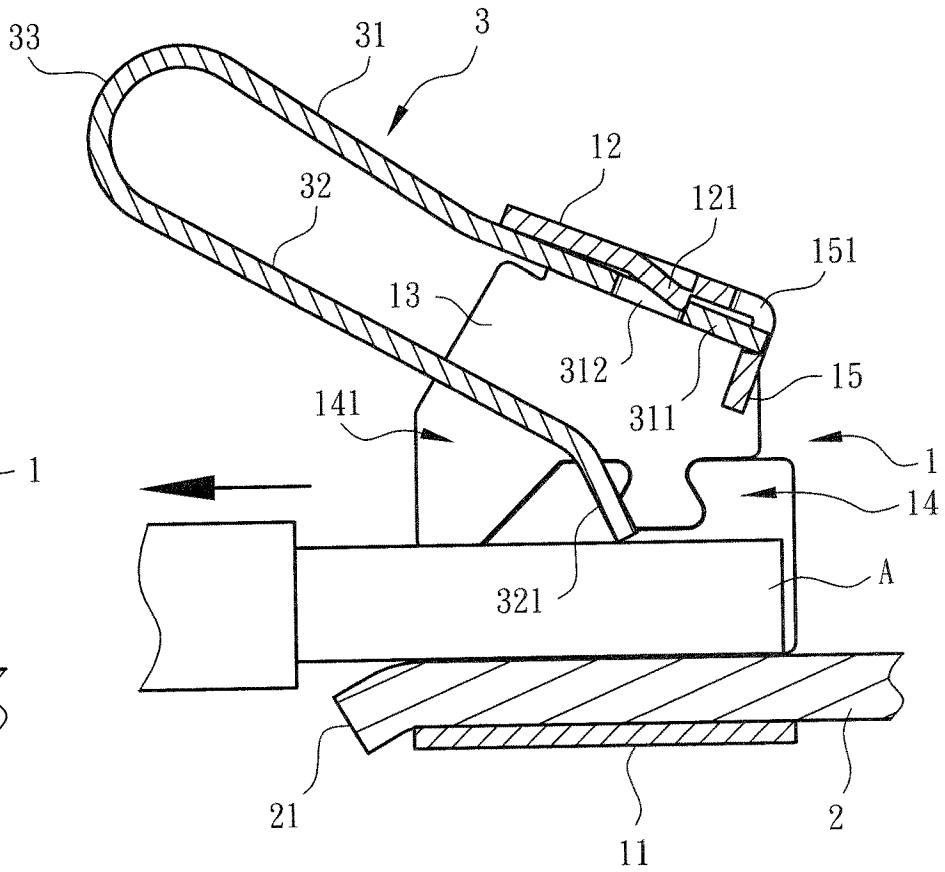
FIG. 4 is a sectional view according to FIG. 3, showing that the external conductive wire is fastened by the metal leaf spring and hindered from being extracted out of the terminal.
Figure 3:
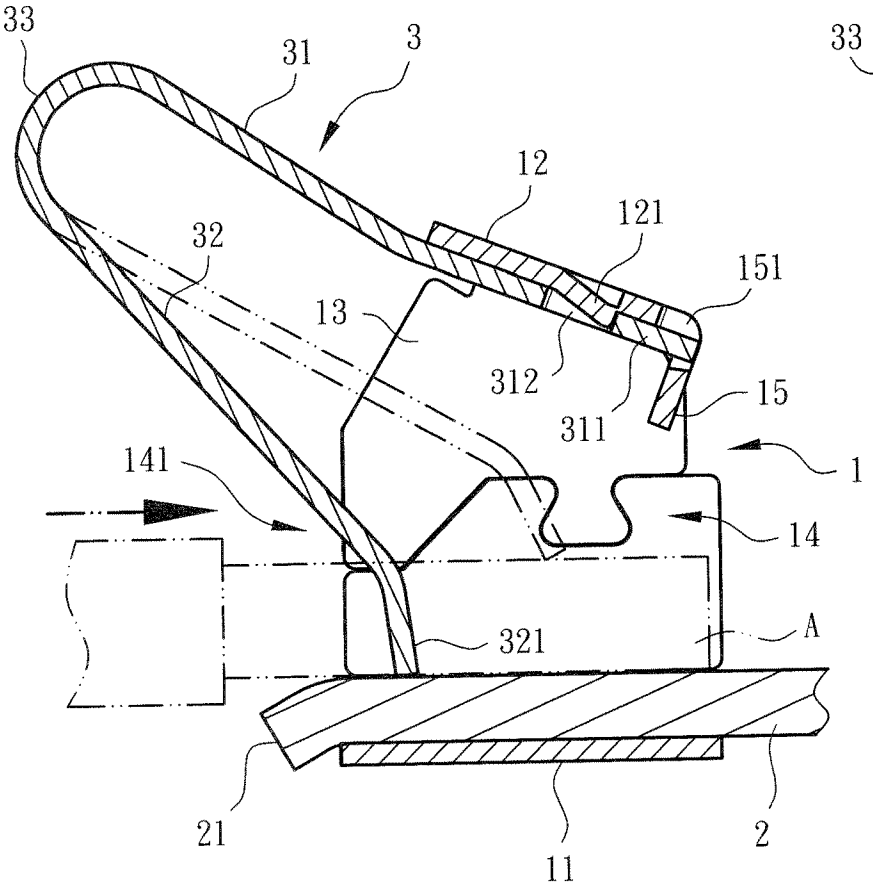
FIG. 3 is an operational sectional view of the first embodiment of the present invention, showing that the external conductive wire is plugged into the terminal to push the metal leaf spring.

As shown in FIG. 4, when the conductive wire A is pulled by the external force, the first section 31 of the metal leaf spring 3 bears a clockwise torque. At this time, by means of the design that the second locating section 15 (such as the perforation 151) is fitted with the second located section 311, the force applied by the insertion section 312 to the elastic locating section 121 is effectively reduced. Therefore, the possibility of deformation of the elastic locating section 121 due to the force is minified. In this case, the conductive wire A can be more securely assembled with the terminal without easy loosening and detachment.

That is, when the first section 31 extends into the assembling passage 14 corresponding to the connection side section 12 and the first section 31 elastically pushes/presses the elastic locating section 121 until the insertion section 312 reaches the elastic locating section 121, the elastic locating section 121 is elastically engaged into the insertion section 312 and cooperates with the second locating section 15 to secure the second located section 311 of the first section 31 of the metal leaf spring. Accordingly, the first section 31 of the metal leaf spring and the connection side section 12 form a multi-portion locating system, whereby when an operator plugs the conductive wire A into and/or extracts the conductive wire A out of the terminal, the pulling force (or so-called external action force) of the operator is prevented from making the metal leaf spring 3 loosen or detach from the protection member 1.

Especially, the first section 31 of the U-shaped metal leaf spring 3 is connected with the inner surface of the preset connection side section 12 of the protection member 1, whereby the first section 31 of the metal leaf spring is respectively securely connected with the front and rear sides of the contact portion of the connection side section 12 and the end section 321 of the second section 32 of the metal leaf spring abuts against the conductive plate 2. When an operator plugs the conductive wire A into and/or extracts the conductive wire A out of the terminal, the metal leaf spring 3 (or the first section 31) will displace in response to the pulling force (or so-called external action force) of the operator. The maximum displacement amount is limited within a movable range together defined by the assembling structure of the elastic locating section 121 and the insertion section 312 and the second locating section 15 and the second located section 311 (two positions). (That is, the movable distance of the second located section 311 and the insertion section 312 is limited or regulated within the allowable motional range together defined by the elastic locating section 121 and the second locating section 15). Accordingly, a connection effect without easy loosening is set up between the protection member 1, the metal leaf spring 3 and the conductive plate 2.

Therefore, it can be realized that the assembling structure of the elastic locating section 121 engaged in the insertion section 312 (in cooperation with the second locating section 15) interrupts the extraction path of the metal leaf spring 3 (or the first section 31). The metal leaf spring 3 (or the first section 31) cannot be retreated out of the protection member 1 from the aforesaid allowable motional range unless an operator operates the elastic locating section 121 to separate from the insertion section 312.

Figure 5:
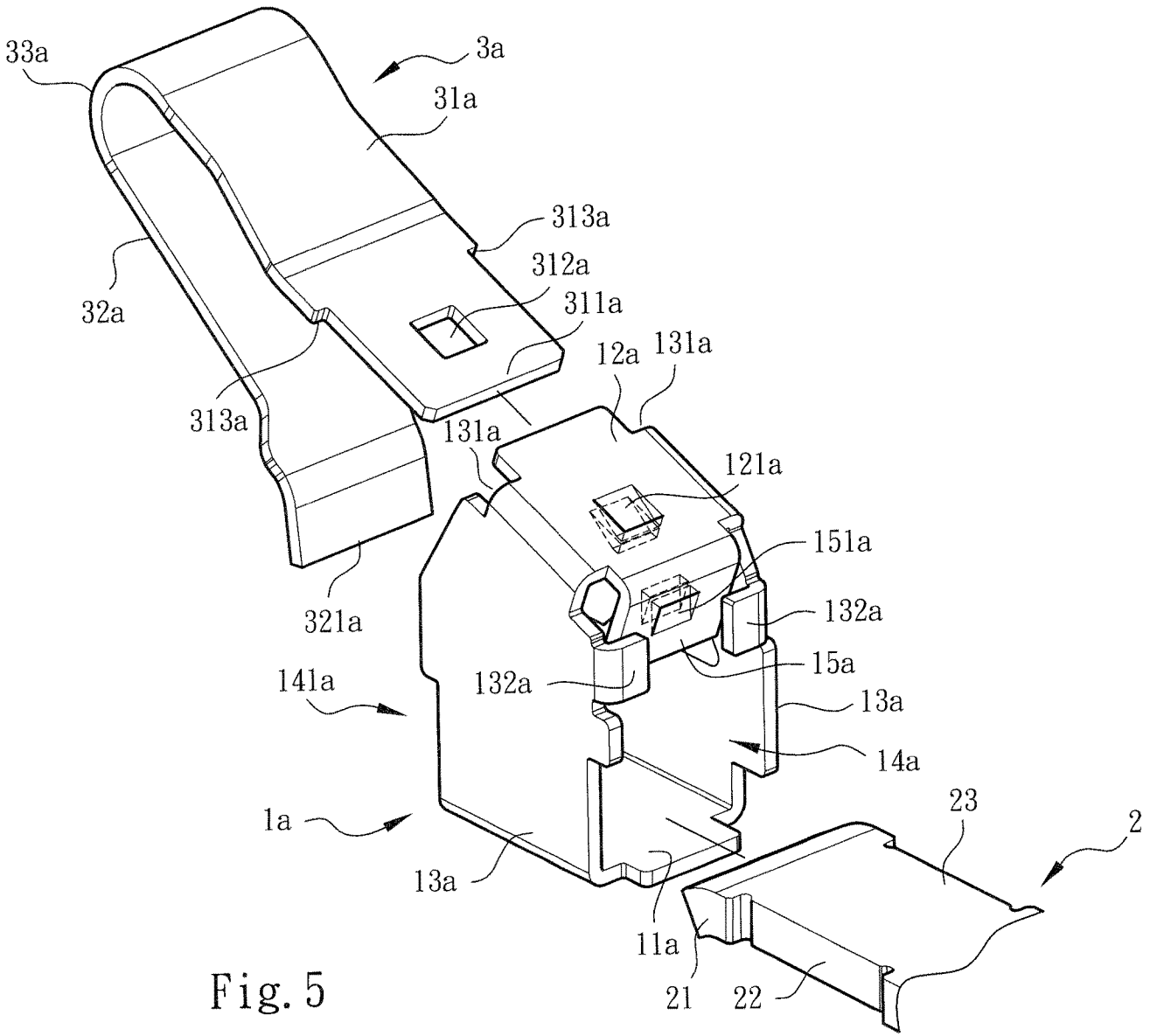
FIG. 5 is a perspective exploded view of a second embodiment of the present invention.
Figure 7:
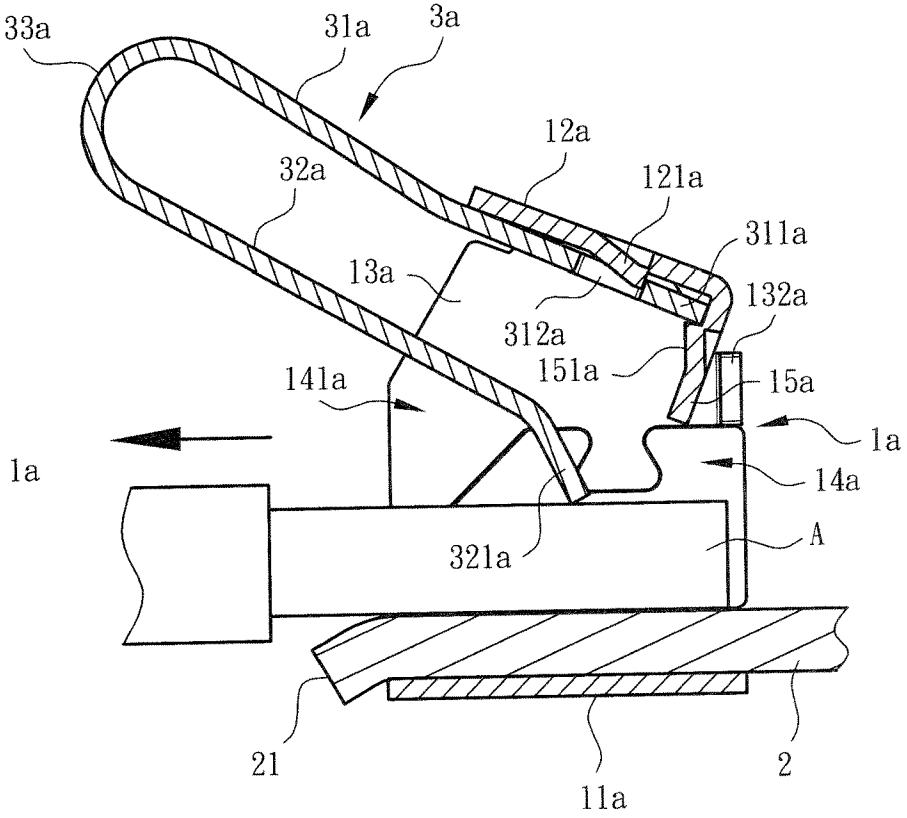
FIG. 7 is a sectional view according to FIG. 6, showing that the external conductive wire is fastened by the metal leaf spring and hindered from being extracted out of the terminal.
Figure 6:
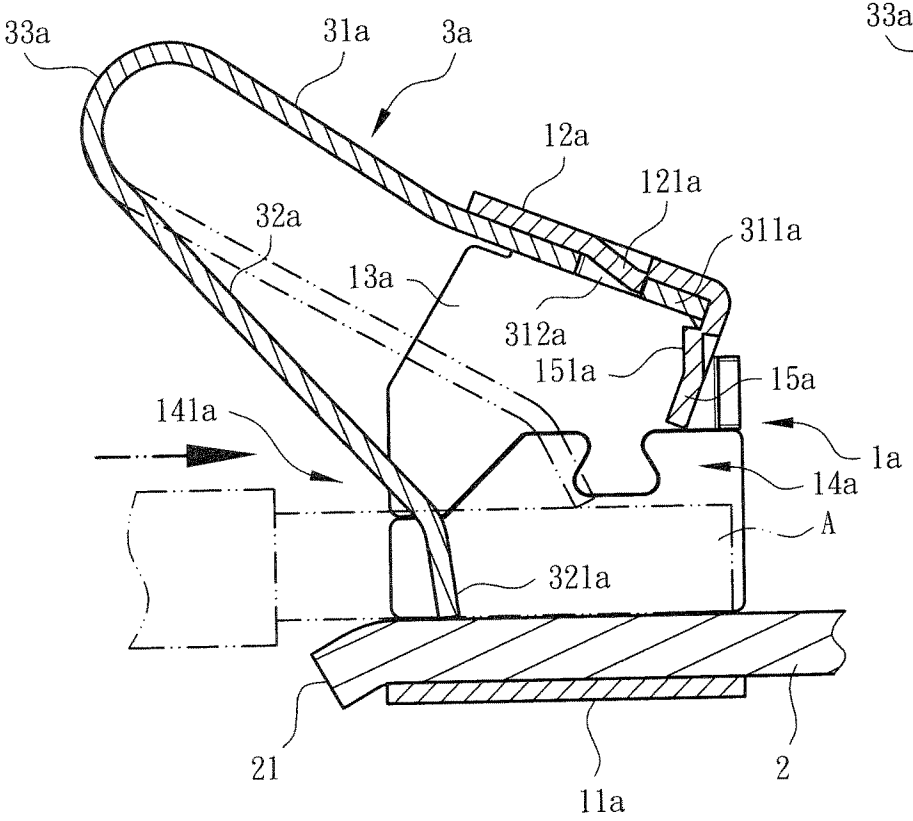
FIG. 6 is an operational sectional view of the second embodiment of the present invention, showing that the external conductive wire is plugged into the terminal to push the metal leaf spring.

Please now refer to FIGS. 5 to 7. According to a second embodiment, the rail terminal assembling structure of the present invention includes a protection member 1*a*, a metal leaf spring 3*a* and a conductive plate 2 identical to the conductive plate of the first embodiment. The protection member 1*a* has a contact side section 11*a* and a connection side section 12*a* opposite to each other. Two lateral sections 13*a* are respectively disposed on two sides of the connection side section 12*a*. The lateral sections 13*a* extend from the two sides of the connection side section 12*a* to connect with two sides of the contact side section 11*a* so as to define an assembling passage 14*a* passing through the protection member 1*a*. One end of the assembling passage 14*a* is a wire inlet 141*a*. A first locating section 131*a*, (such as a lateral notch) is formed at the junction between the connection side section 12*a* and each of the two lateral sections 13*a*. In addition, a second locating section 15*a* is disposed on one side of the protection member 1*a* distal from the first locating sections 131*a*. Moreover, an elastic locating section 121*a* is disposed on the connection side section 12*a*. The elastic locating section 121*a* protrudes toward the assembling passage 14*a*.

In a preferred embodiment, the second locating section 15*a* is a stop plate downward bent from an edge of the connection side section 12*a* toward the assembling passage 14*a*. A middle section of the stop plate is punched to form an upward protruding elastic tongue section 151*a* (obliquely) protruding toward the connection side section 12*a*. A gap is reserved between the upward protruding elastic tongue section 151*a* and the connection side section 12*a*. The elastic locating section 121*a* is a protruding elastic locating tongue section formed by means of punching. In addition, two lateral stop sections 132*a* are respectively disposed on the two lateral sections 13*a* near an edge of the second locating section 15*a* (the stop plate). The lateral stop sections 132*a* are bent toward the assembling passage 14*a*. The two lateral stop sections 132*a* respectively abut against two lateral outer sides of the second locating section 15*a* (the stop plate).

The conductive plate 2 is securely assembled and connected on the inner surface of the contact side section 11*a* of the protection member 1*a* in the same manner as the first embodiment.

The metal leaf spring 3*a* has a first section 31*a*, a second section 32*a* and an elastic bight section 33*a* connected between the first and second sections 31*a*, 32*a*. Accordingly, the metal leaf spring 3*a* is a substantially U-shaped member. Two outward expanded first located sections 313*a* are respectively disposed on two sides of the first section 31*a* of the metal leaf spring 3*a* near the middle of the first section 31*a*, (such as lateral protrusion sections). The first section 31*a* is formed with an insertion section 312*a* (in the form of a locating hole) corresponding to the elastic locating section 121*a*. An end section 321*a* is disposed at a tail end of the second section 32*a*. The end section 321*a* is arched and bent toward the contact side section 11*a*.

When assembled, after the conductive plate 2 is connected with the protection member 1*a*, the metal leaf spring 3*a* is extended into the assembling passage 14*a* with the first section 31*a* attached to the connection side section 12*a*. The second locating section 15*a* (the stop plate) serves to stop the tail end of the first section 31*a* of the metal leaf spring 3*a* (or the second located section 311*a*). The tail end of the first section 31*a* (or the second located section 311*a*) is directly inserted into the gap between the upward protruding elastic tongue section 151*a* and the connection side section 12*a*. In addition, the elastic locating section 121*a* (the elastic locating tongue section) is cooperatively extended into the insertion section 312*a*. The two first located sections 313*a* (the lateral protrusion sections) are respectively located in the two first locating sections 131*a* (the lateral notches). Accordingly, the first section 31*a* of the metal leaf spring 3*a* is securely connected with the connection side section 12*a* of the protection member 1*a* to locate the metal leaf spring 3*a*. Also, the end section 321*a* of the second section 32*a* of the metal leaf spring 3*a* abuts against the inner face 23 of the conductive plate 2.

In use, the external conductive wire A extends into the assembling passage 14*a* from one side near the first locating section 131*a* (the lateral notch). At this time, the conductive wire A first pushes the second section 32*a* of the metal leaf spring 3*a* to elastically compress and deform the elastic bight section 33*a*. After the conductive wire A passes through the end section 321*a*, under the elastic restoring force of the elastic bight section 33*a*, the end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

That is, when the first section 31*a* extends into the assembling passage 14*a* corresponding to the connection side section 12*a* and the first section 31*a* elastically pushes/presses the elastic locating section 121*a* until the insertion section 312*a* reaches the elastic locating section 121*a*, the elastic locating section 121*a* is elastically engaged into the insertion section 312*a* and cooperates with the second locating section 15*a* (and/or the upward protruding elastic tongue section 151*a*) to secure the second located section 311*a* of the first section 31*a* of the metal leaf spring. Accordingly, the first section 31*a* of the metal leaf spring and the connection side section 12*a* form a multi-portion locating system, whereby when an operator plugs the conductive wire A into and/or extracts the conductive wire A out of the terminal, the external action force of the operator is prevented from making the metal leaf spring 3*a* loosen or detach from the protection member 1*a*.

Especially, the first section 31*a* of the U-shaped metal leaf spring 3*a* is connected with the inner surface of the preset connection side section 12*a* of the protection member 1*a*, whereby the first section 31*a* of the metal leaf spring is respectively securely connected with the front and rear sides of the contact portion of the connection side section 12*a* and the end section 321*a* of the second section 32*a* of the metal leaf spring abuts against the conductive plate 2. When an operator plugs the conductive wire A into and/or extracts the conductive wire A out of the terminal, the metal leaf spring 3*a* (or the first section 31*a*) will displace in response to the external action force of the operator. The maximum displacement amount is limited within a movable range together defined by the assembling structure of the elastic locating section 121*a* and the insertion section 312*a* and the second locating section 15*a* (and/or the upward protruding elastic tongue section 151*a*) and the second located section 311*a* (two positions). (That is, the movable distance of the second located section 311*a* and the insertion section 312*a* is limited or regulated within the allowable motional range together defined by the elastic locating section 121*a* and the second locating section 15*a* (and/or the upward protruding elastic tongue section 151*a*)). Accordingly, a connection effect without easy loosening is set up between the protection member 1*a*, the metal leaf spring 3*a* and the conductive plate 2.

Therefore, it can be realized that the assembling structure of the elastic locating section 121*a* engaged in the insertion section 312*a* (in cooperation with the second locating section 15 and/or upward protruding elastic tongue section 151*a*) interrupts the extraction path of the metal leaf spring 3*a* (or the first section 31*a*). The metal leaf spring 3*a* (or the first section 31*a*) cannot be retreated out of the protection member 1*a* from the aforesaid allowable motional range unless an operator operates the elastic locating section 121*a* to separate from the insertion section 312*a*.

Figure 8:
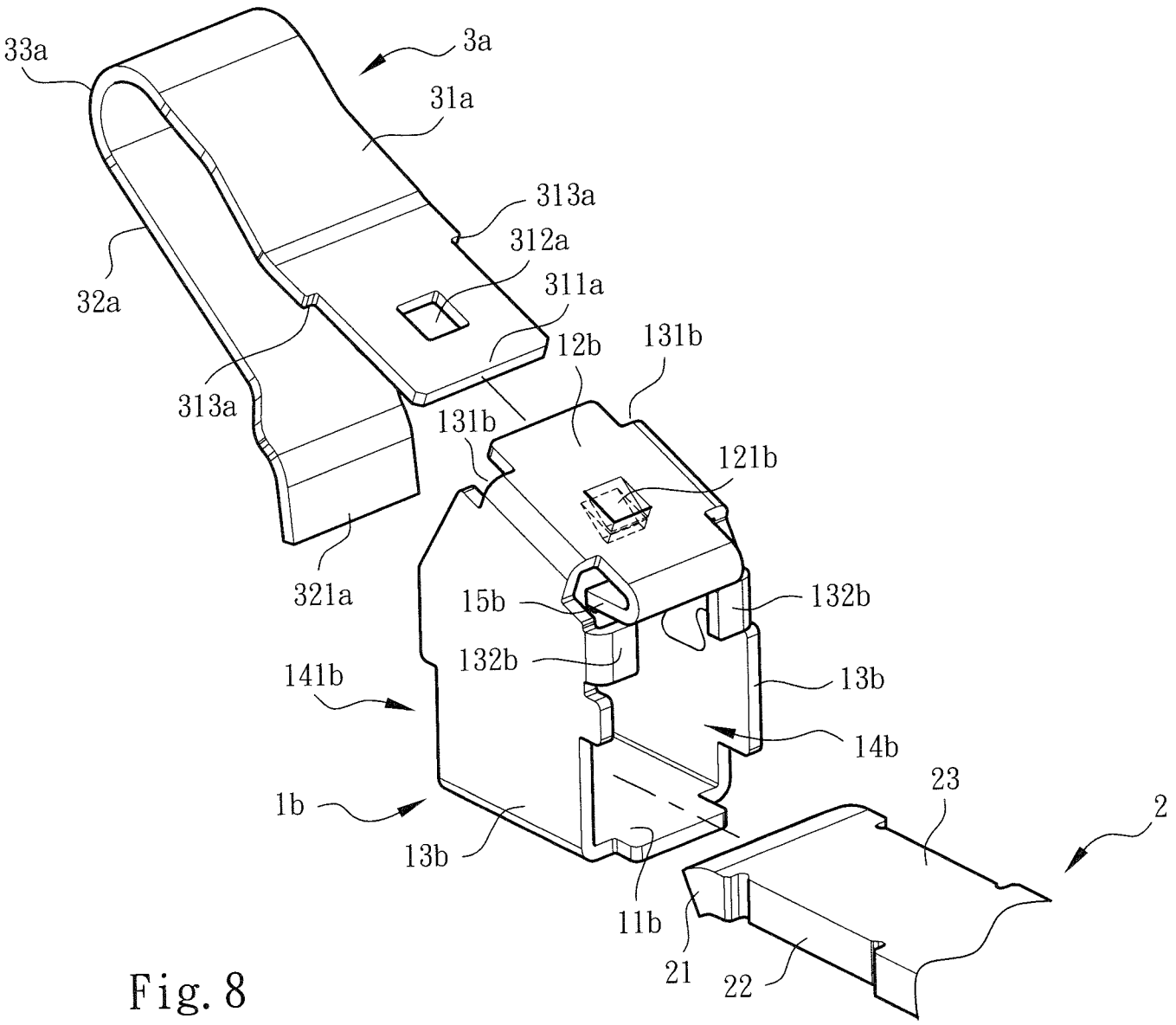
FIG. 8 is a perspective exploded view of a third embodiment of the present invention.
Figure 10:
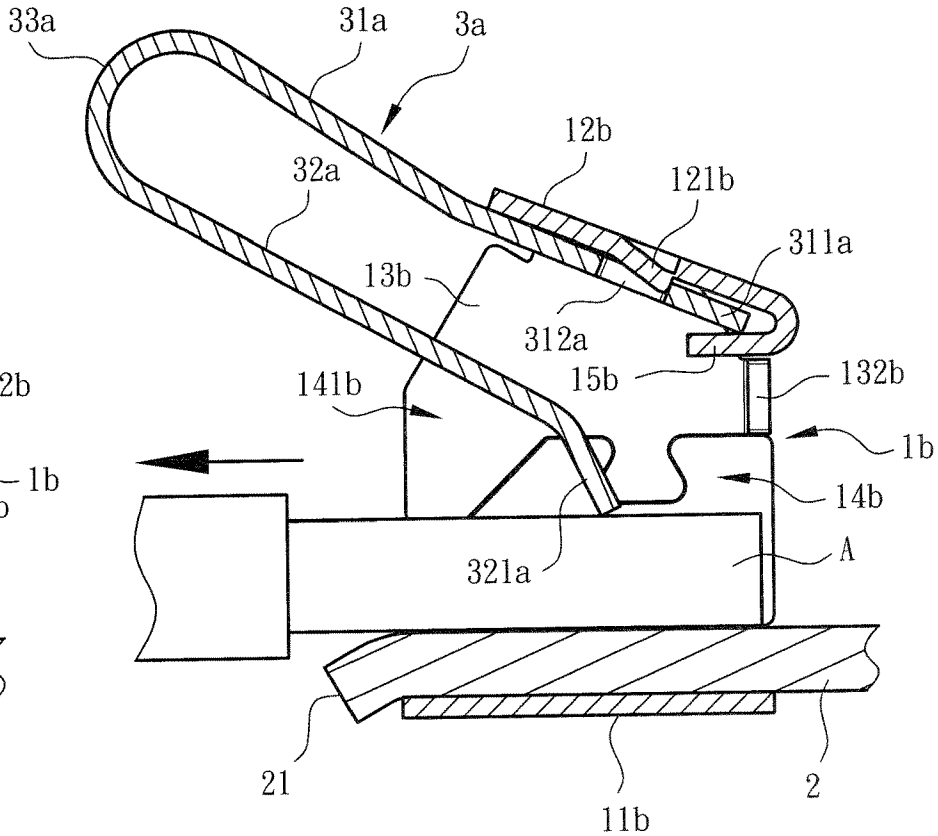
FIG. 10 is a sectional view according to FIG. 9, showing that the external conductive wire is fastened by the metal leaf spring and hindered from being extracted out of the terminal.
Figure 9:
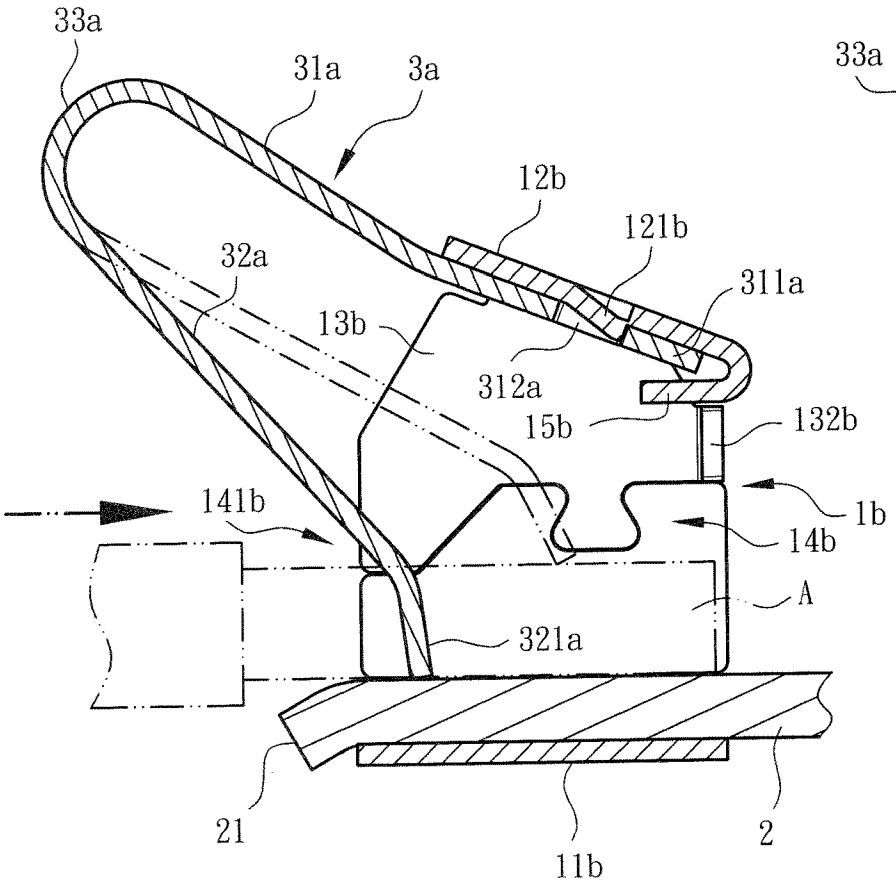
FIG. 9 is an operational sectional view of the third embodiment of the present invention, showing that the external conductive wire is plugged into the terminal to push the metal leaf spring.

Please now refer to FIGS. 8 to 10. According to a third embodiment, the rail terminal assembling structure of the present invention includes a protection member 1*b* and a conductive plate 2 and metal leaf spring 3*a* identical to the conductive plate and metal leaf spring of the second embodiment. The protection member 1*b* has a contact side section 11*b* and a connection side section 12*b* opposite to each other. Two lateral sections 13*b* are respectively disposed on two sides of the connection side section 12*b*. The lateral sections 13*b* extend from the two sides of the connection side section 12*b* to connect with two sides of the contact side section 11*b* so as to define an assembling passage 14*b* passing through the protection member 1*b*. One end of the assembling passage 14*b* is a wire inlet 141*b*. A first locating section 131*b*, (such as a lateral notch) is formed at the junction between the connection side section 12*b* and each of the two lateral sections 13*b*. In addition, a second locating section 15*b* is disposed on one side of the protection member 1*b* distal from the first locating sections 131*b* (the lateral notch). Moreover, an elastic locating section 121*b* is disposed on the connection side section 12*b*. The elastic locating section 121*b* protrudes toward the assembling passage 14*b*.

In a preferred embodiment, the second locating section 15*b* is a bent plate extending into the assembling passage 14*b* and bent toward the first locating sections 131*b* (the lateral notch). In addition, two lateral stop sections 132*b* are respectively disposed on the two lateral sections 13*b* near an edge of the second locating section 15*b* (the bent plate). The lateral stop sections 132*b* are bent toward the assembling passage 14*b*. The two lateral stop sections 132*b* respectively abut against the bottom side of the second locating section 15*b* (the bent plate).

The conductive plate 2 is securely assembled and connected on the inner surface of the contact side section 11*b* of the protection member 1*b* in the same manner as the first embodiment.

When assembled, after the conductive plate 2 is connected with the protection member 1*b*, the metal leaf spring 3*a* is extended into the assembling passage 14*b* with the first section 31*a* attached to the connection side section 12*b*. The second locating section 15*b* (the bent plate) serves to hold the tail end of the first section 31*a* of the metal leaf spring 3*a* (or the second located section 311*a*). In addition, the elastic locating section 121*b* (the elastic locating tongue section) is cooperatively extended into the insertion section 312*a*. The two first located sections 313*a* (the lateral protrusion sections) are respectively inserted in the two first locating sections 131*b* (the lateral notches). Accordingly, the first section 31*a* of the metal leaf spring 3*a* is securely connected with the connection side section 12*b* of the protection member 1*b* to locate the metal leaf spring 3*a*. Also, the end section 321*a* of the second section 32*a* of the metal leaf spring 3*a* abuts against the inner face 23 of the conductive plate 2.

In use, the external conductive wire A extends into the assembling passage 14*b* from one side near the first locating section 131*b* (the lateral notch). At this time, the conductive wire A first pushes the second section 32*a* of the metal leaf spring 3*a* to elastically compress and deform the elastic bight section 33*a*. After the conductive wire A passes through the end section 321*a*, under the elastic restoring force of the elastic bight section 33*a*, the end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

That is, when the first section 31*a* extends into the assembling passage 14*b* corresponding to the connection side section 12*b* and the first section 31*a* elastically pushes/presses the elastic locating section 121*b* until the insertion section 312*a* reaches the elastic locating section 121*b*, the elastic locating section 121*b* is elastically engaged into the insertion section 312*a* and cooperates with the second locating section 15*b* to secure the second located section 311*a* of the first section 31*a* of the metal leaf spring. Accordingly, the first section 31*a* of the metal leaf spring and the connection side section 12*b* form a multi-portion locating system, whereby when an operator plugs the conductive wire A into and/or extracts the conductive wire A out of the terminal, the external action force of the operator is prevented from making the metal leaf spring 3*a* loosen or detach from the protection member 1*b*.

Especially, the first section 31*a* of the U-shaped metal leaf spring 3*a* is connected with the inner surface of the preset connection side section 12*b* of the protection member 1*b*, whereby the first section 31*a* of the metal leaf spring is respectively securely connected with the front and rear sides of the contact portion of the connection side section 12*b* and the end section 321*a* of the second section 32*a* of the metal leaf spring abuts against the conductive plate 2. When an operator plugs the conductive wire A into and/or extracts the conductive wire A out of the terminal, the metal leaf spring 3*a* (or the first section 31*a*) will displace in response to the external action force of the operator. The maximum displacement amount is limited within a movable range together defined by the assembling structure of the elastic locating section 121*b* and the insertion section 312*a* and the second locating section 15*b* and the second located section 311*a* (two positions). (That is, the movable distance of the second located section 311*b* and the insertion section 312*a* is limited or regulated within the allowable motional range together defined by the elastic locating section 121*b* and the second locating section 15*a*). Accordingly, a connection effect without easy loosening is set up between the protection member 1*b*, the metal leaf spring 3*a* and the conductive plate 2.

Figure 11:
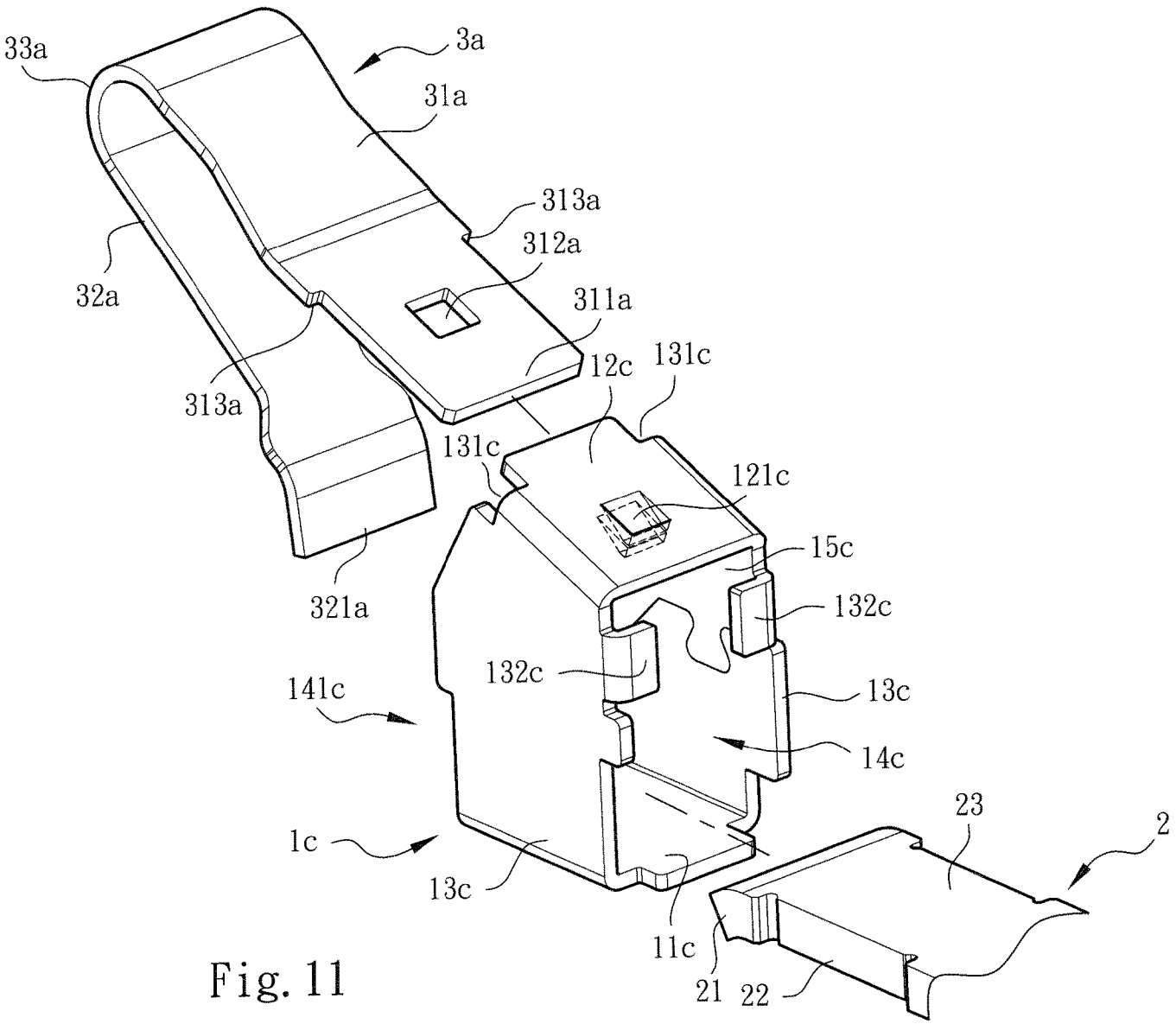
FIG. 11 is a perspective exploded view of a fourth embodiment of the present invention.
Figure 13:
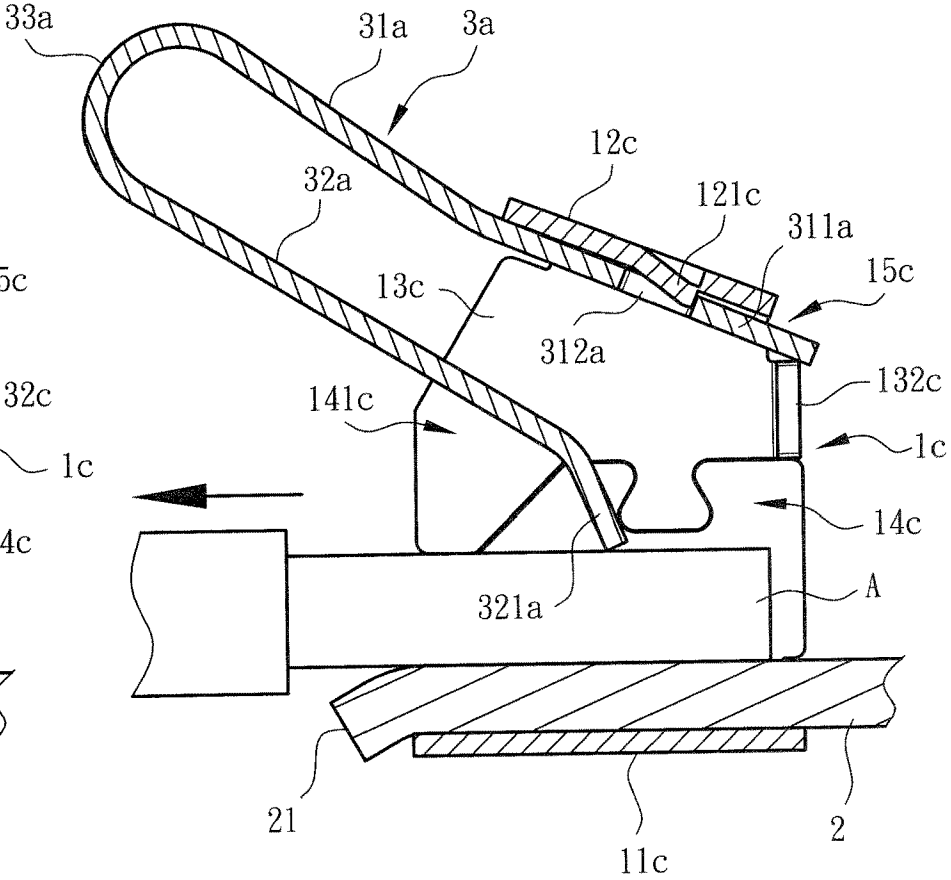
FIG. 13 is a sectional view according to FIG. 12, showing that the external conductive wire is fastened by the metal leaf spring and hindered from being extracted out of the terminal.
Figure 12:
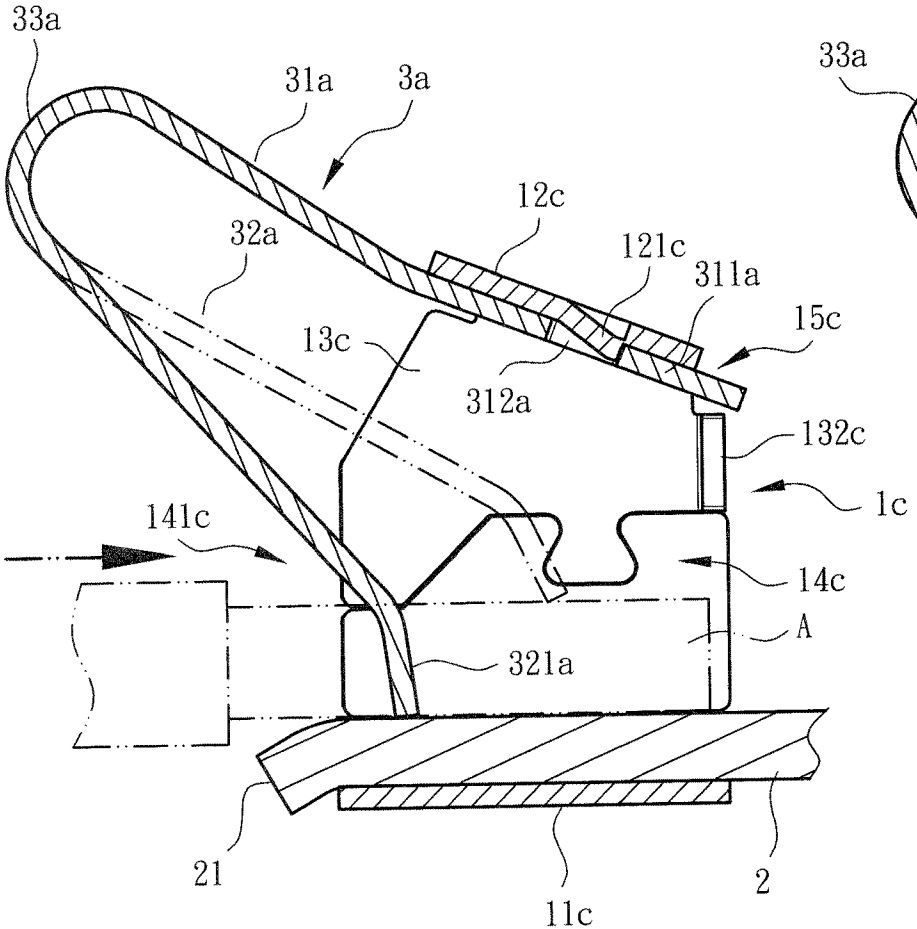
FIG. 12 is an operational sectional view of the fourth embodiment of the present invention, showing that the external conductive wire is plugged into the terminal to push the metal leaf spring.

Please now refer to FIGS. 11 to 13. According to a fourth embodiment, the rail terminal assembling structure of the present invention includes a protection member 1*c* and a conductive plate 2 and metal leaf spring 3*a* identical to the conductive plate and metal leaf spring of the second embodiment. The protection member 1*c* has a contact side section 11*c* and a connection side section 12*c* opposite to each other. Two lateral sections 13*c* are respectively disposed on two sides of the connection side section 12*c*. The lateral sections 13*c* extend from the two sides of the connection side section 12*c* to connect with two sides of the contact side section 11*c* so as to define an assembling passage 14*c* passing through the protection member 1*c*. One end of the assembling passage 14*c* is a wire inlet 141*c*. A first locating section 131*c*, (such as a lateral notch) is formed at the junction between the connection side section 12*c* and each of the two lateral sections 13*c*. In addition, two second locating sections 132*c* are disposed at one end of the protection member 1*c* distal from the first locating sections 131*c* (the lateral notch). Moreover, an elastic locating section 121*c* is disposed on the connection side section 12*c*. The elastic locating section 121*c* protrudes toward the assembling passage 14*c*.

In a preferred embodiment, the second locating sections 132*c* are two lateral stop sections respectively disposed on an edge of each of the two lateral sections 13*c* distal from the first locating section 131*c* (the lateral notch). The lateral stop sections are bent toward the assembling passage 14*c*. In addition, a gap 15*c* is reserved between the second locating sections 132*c* (the lateral stop sections) and the connection side section 12*c*.

The conductive plate 2 is securely assembled and connected on the inner surface of the contact side section 11*c* of the protection member 1*c* in the same manner as the first embodiment.

When assembled, after the conductive plate 2 is connected with the protection member 1*c*, the metal leaf spring 3*a* is extended into the assembling passage 14*c* with the first section 31*a* attached to the connection side section 12*c*. The tail end of the first section 31*a*, (that is, the second located section 311*a*) is directly passed through the gap 15*c* and the elastic locating section 121*c* (the elastic locating tongue section) is cooperatively extended into the insertion section 312*a*. The two first located sections 313*a* (the lateral protrusion sections) are respectively engaged in the two first locating sections 131*c* (the lateral notches). Accordingly, the first section 31*a* of the metal leaf spring 3*a* is securely connected with the connection side section 12*c* of the protection member 1*c* to locate the metal leaf spring 3*a*. Also, the end section 321*a* of the second section 32*a* of the metal leaf spring 3*a* abuts against the inner face 23 of the conductive plate 2.

In use, the external conductive wire A extends into the assembling passage 14*c* from one side near the first locating section 131*c* (the lateral notch). At this time, the conductive wire A first pushes the second section 32*a* of the metal leaf spring 3*a* to elastically compress and deform the elastic bight section 33*a*. After the conductive wire A passes through the end section 321*a*, under the elastic restoring force of the elastic bight section 33*a*, the end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

That is, when the first section 31*a* extends into the assembling passage 14*c* corresponding to the connection side section 12*c* and the first section 31*a* elastically pushes/presses the elastic locating section 121*c* until the insertion section 312*a* reaches the elastic locating section 121*c*, the elastic locating section 121*c* is elastically engaged into the insertion section 312*a* and cooperates with the second locating section 132*c* (or the gap 15*c*) to secure the second located section 311*a* of the first section 31*a* of the metal leaf spring. Accordingly, the first section 31*a* of the metal leaf spring and the connection side section 12*c* form a multi-portion locating system, whereby when an operator plugs the conductive wire A into and/or extracts the conductive wire A out of the terminal, the external action force of the operator is prevented from making the metal leaf spring 3*a* loosen or detach from the protection member 1*c*.

Especially, the first section 31*a* of the U-shaped metal leaf spring 3*a* is connected with the inner surface of the preset connection side section 12*c* of the protection member 1*c*, whereby the first section 31*a* of the metal leaf spring is respectively securely connected with the front and rear sides of the contact portion of the connection side section 12*c* and the end section 321*a* of the second section 32*a* of the metal leaf spring abuts against the conductive plate 2. When an operator plugs the conductive wire A into and/or extracts the conductive wire A out of the terminal, the metal leaf spring 3*a* (or the first section 31*a*) will displace in response to the external action force of the operator. The maximum displacement amount is limited within a movable range together defined by the assembling structure of the elastic locating section 121*c* and the insertion section 312*a* and the second locating section 132*c* (or the gap 15*c*) and the second located section 311*a* (two positions). (That is, the movable distance of the second located section 311*a* and the insertion section 312*a* is limited or regulated within the allowable motional range together defined by the elastic locating section 121*c* and the second locating section 132*c*). Accordingly, a connection effect without easy loosening is set up between the protection member 1*c*, the metal leaf spring 3*a* and the conductive plate 2.

Therefore, it can be realized that the assembling structure of the elastic locating section 121*c* engaged in the insertion section 312*a* (in cooperation with the second locating section 132*c*) interrupts the extraction path of the metal leaf spring 3*a* (or the first section 31*a*). The metal leaf spring 3*a* (or the first section 31*a*) cannot be retreated out of the protection member 1*c* from the aforesaid allowable motional range unless an operator operates the elastic locating section 121*c* to separate from the insertion section 312*a*.

Figure 14:
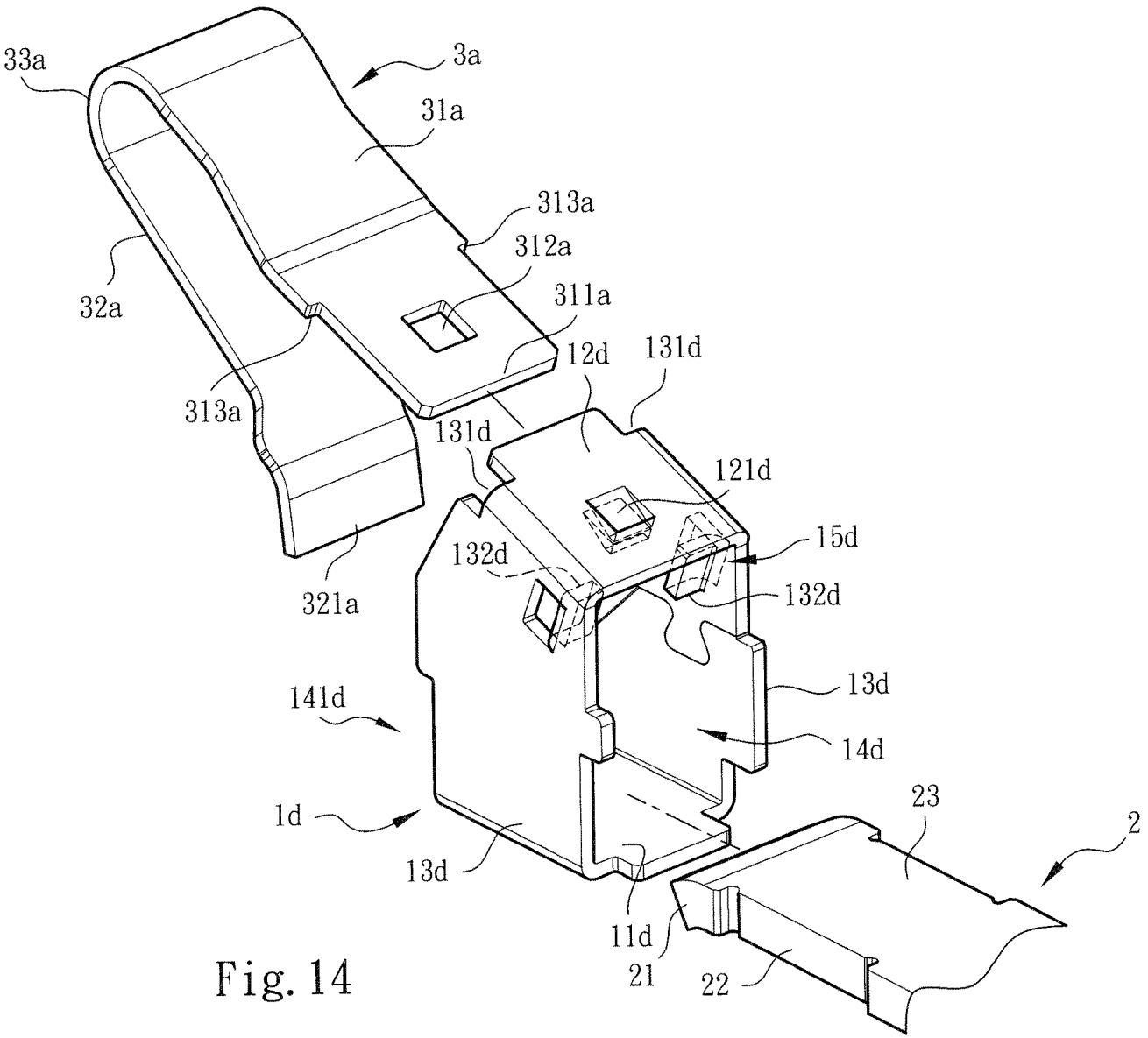
FIG. 14 is a perspective exploded view of a fifth embodiment of the present invention.
Figure 16:
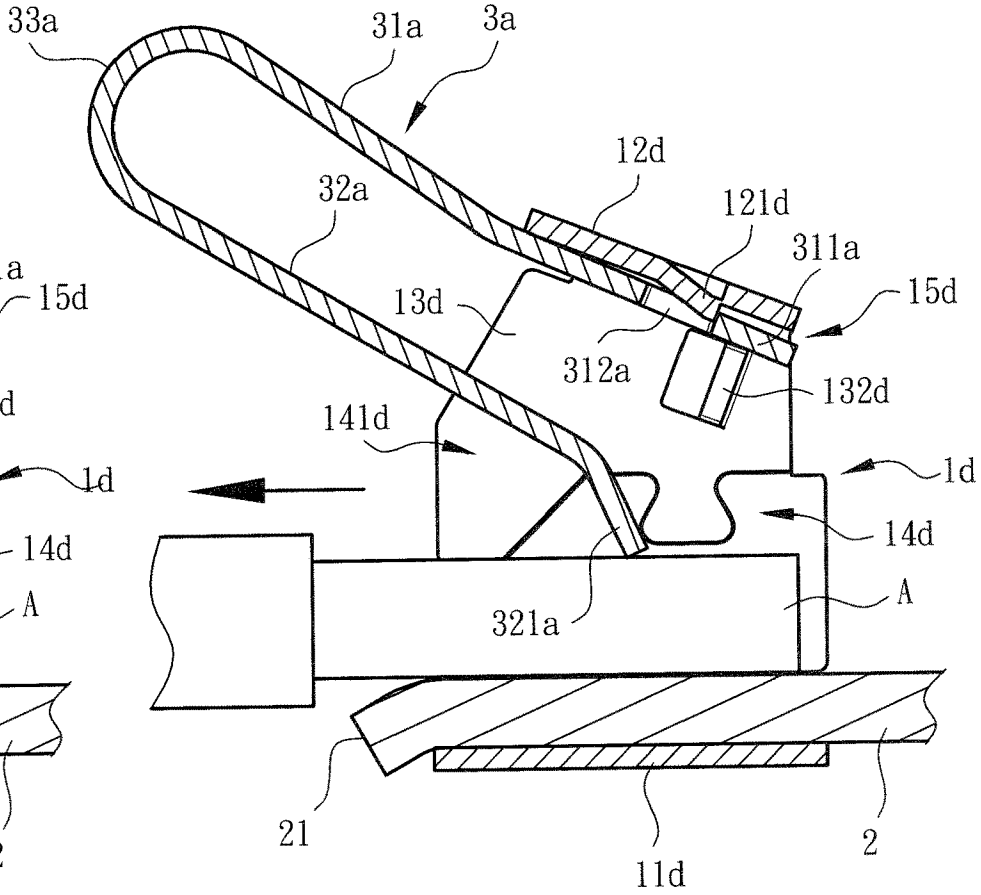
FIG. 16 is a sectional view according to FIG. 15, showing that the external conductive wire is fastened by the metal leaf spring and hindered from being extracted out of the terminal.
Figure 15:
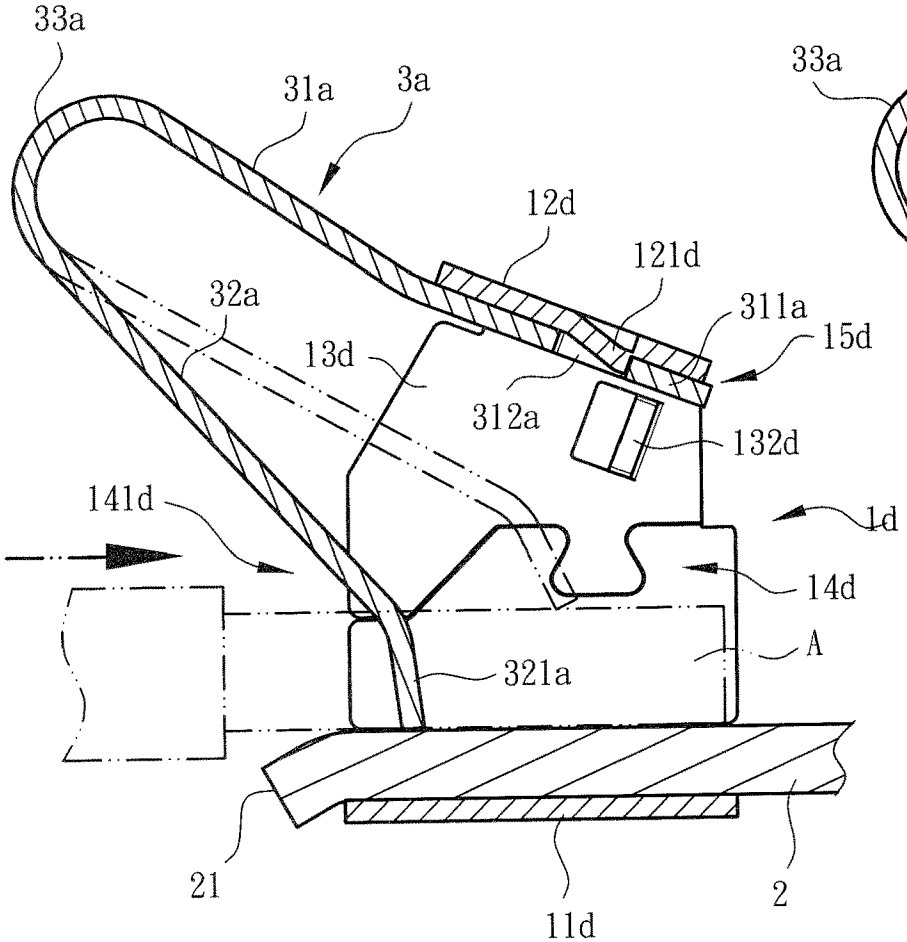
FIG. 15 is an operational sectional view of the fifth embodiment of the present invention, showing that the external conductive wire is plugged into the terminal to push the metal leaf spring.

Please now refer to FIGS. 14 to 16. According to a fifth embodiment, the rail terminal assembling structure of the present invention includes a protection member 1*d* and a conductive plate 2 and metal leaf spring 3*a* identical to the conductive plate and metal leaf spring of the second embodiment. The protection member 1*d* has a contact side section 11*d* and a connection side section 12*d* opposite to each other. Two lateral sections 13*d* are respectively disposed on two sides of the connection side section 12*d*. The lateral sections 13*d* extend from the two sides of the connection side section 12*d* to connect with two sides of the contact side section 11*d* so as to define an assembling passage 14*d* passing through the protection member 1*d*. One end of the assembling passage 14*d* is a wire inlet 141*d*. A first locating section 131*d*, (such as a lateral notch) is formed at the junction between the connection side section 12*d* and each of the two lateral sections 13*d*. In addition, two second locating sections 132*d* are disposed on one side of the protection member 1*d* distal from the first locating sections 131*d* (the lateral notch). Moreover, an elastic locating section 121*d* is disposed on the connection side section 12*d*. The elastic locating section 121*d* protrudes toward the assembling passage 14*d*.

In a preferred embodiment, the second locating sections 132*d* are two lateral stop sections respectively disposed on the middles of the lateral sections 13*d*. The lateral stop sections are transversely bent toward the assembling passage 14*d*. In addition, a gap 15*d* is reserved between the second locating sections 132*d* (the lateral stop sections) and the connection side section 12*d*.

The conductive plate 2 is securely assembled and connected on the inner surface of the contact side section 11*d* of the protection member 1*d* in the same manner as the first embodiment.

When assembled, after the conductive plate 2 is connected with the protection member 1*d*, the metal leaf spring 3*a* is extended into the assembling passage 14*d* with the first section 31*a* attached to the connection side section 12*d*. The second located section 311*a* of the first section 31*a* is directly passed through the gap 15*d* and the elastic locating section 121*d* (the elastic locating tongue section) is cooperatively extended into the insertion section 312*a*. The two first located sections 313*a* (the lateral protrusion sections) are respectively engaged in the two first locating sections 131*d* (the lateral notches). Accordingly, the first section 31*a* of the metal leaf spring 3*a* is securely connected with the connection side section 12*d* of the protection member 1*d* to locate the metal leaf spring 3*a*. Also, the end section 321*a* of the second section 32*a* of the metal leaf spring 3*a* abuts against the inner face 23 of the conductive plate 2.

In use, the external conductive wire A extends into the assembling passage 14*d* from one side near the first locating section 131*d* (the lateral notch). At this time, the conductive wire A first pushes the second section 32*a* of the metal leaf spring 3*a* to elastically compress and deform the elastic bight section 33*a*. After the conductive wire A passes through the end section 321*a*, under the elastic restoring force of the elastic bight section 33*a*, the end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

Figure 17:
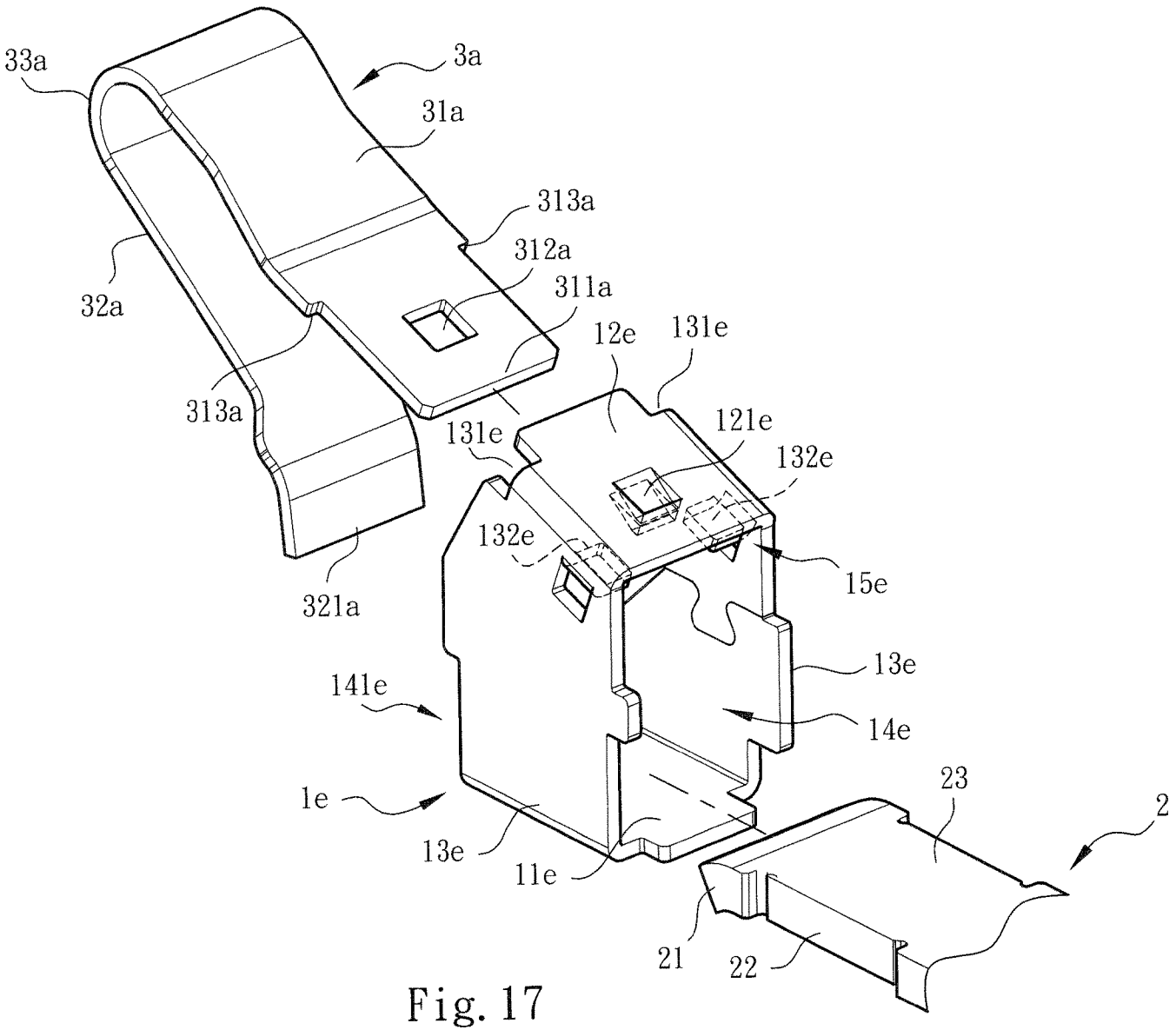
FIG. 17 is a perspective exploded view of a sixth embodiment of the present invention.
Figure 19:
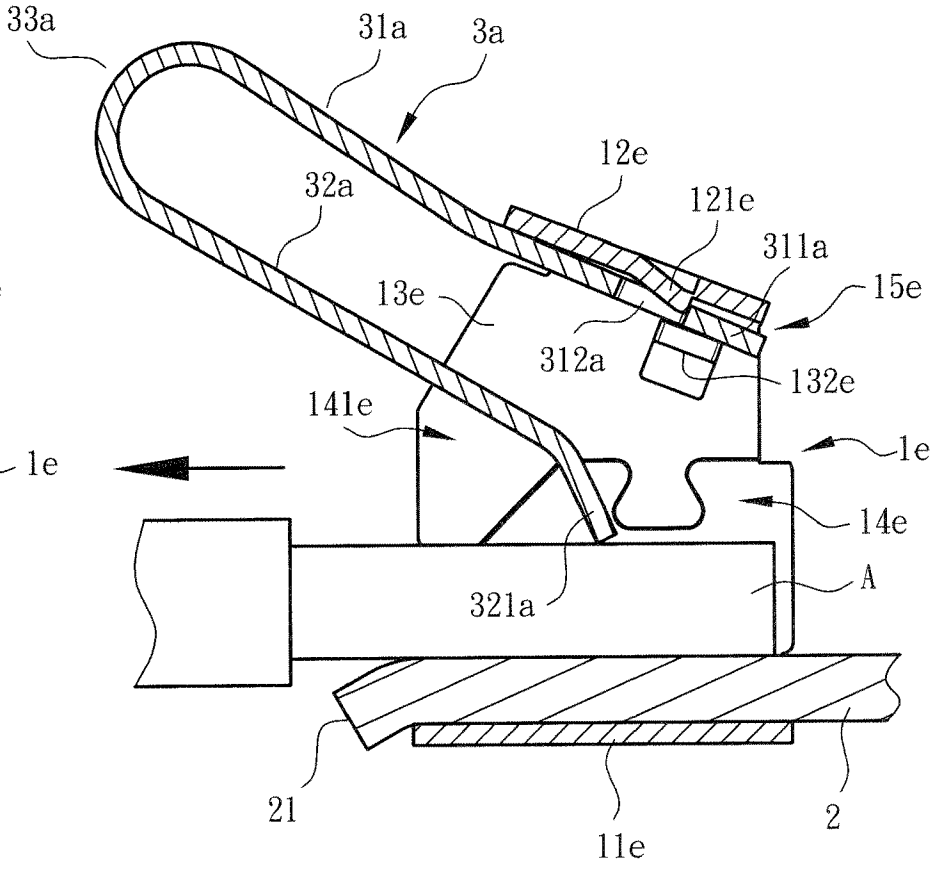
FIG. 19 is a sectional view according to FIG. 18, showing that the external conductive wire is fastened by the metal leaf spring and hindered from being extracted out of the terminal.
Figure 18:
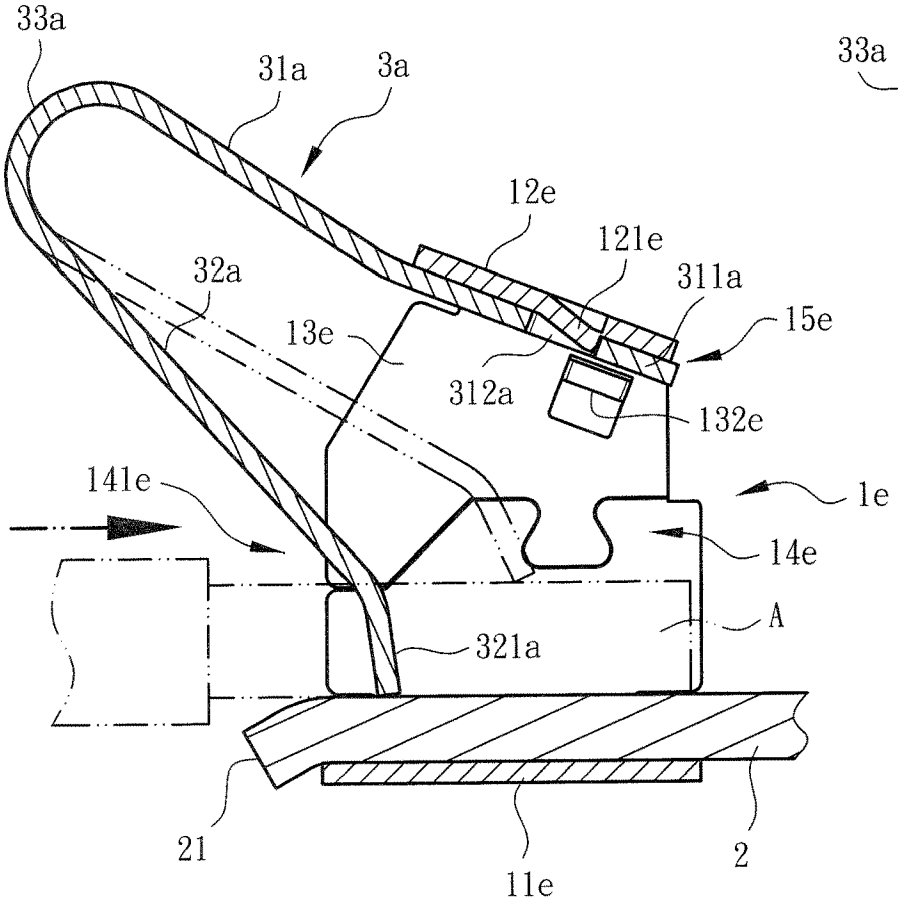
FIG. 18 is an operational sectional view of the sixth embodiment of the present invention, showing that the external conductive wire is plugged into the terminal to push the metal leaf spring.
Figure 20:
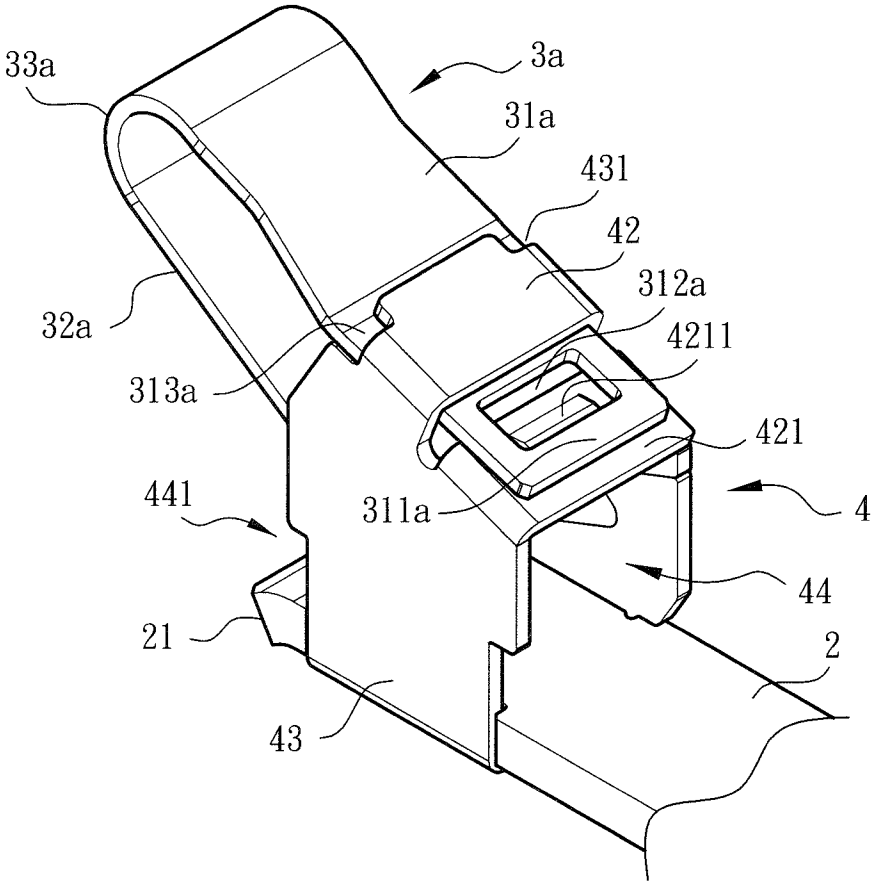
FIG. 20 is a perspective assembled view of a seventh embodiment of the present invention.
Figure 21:
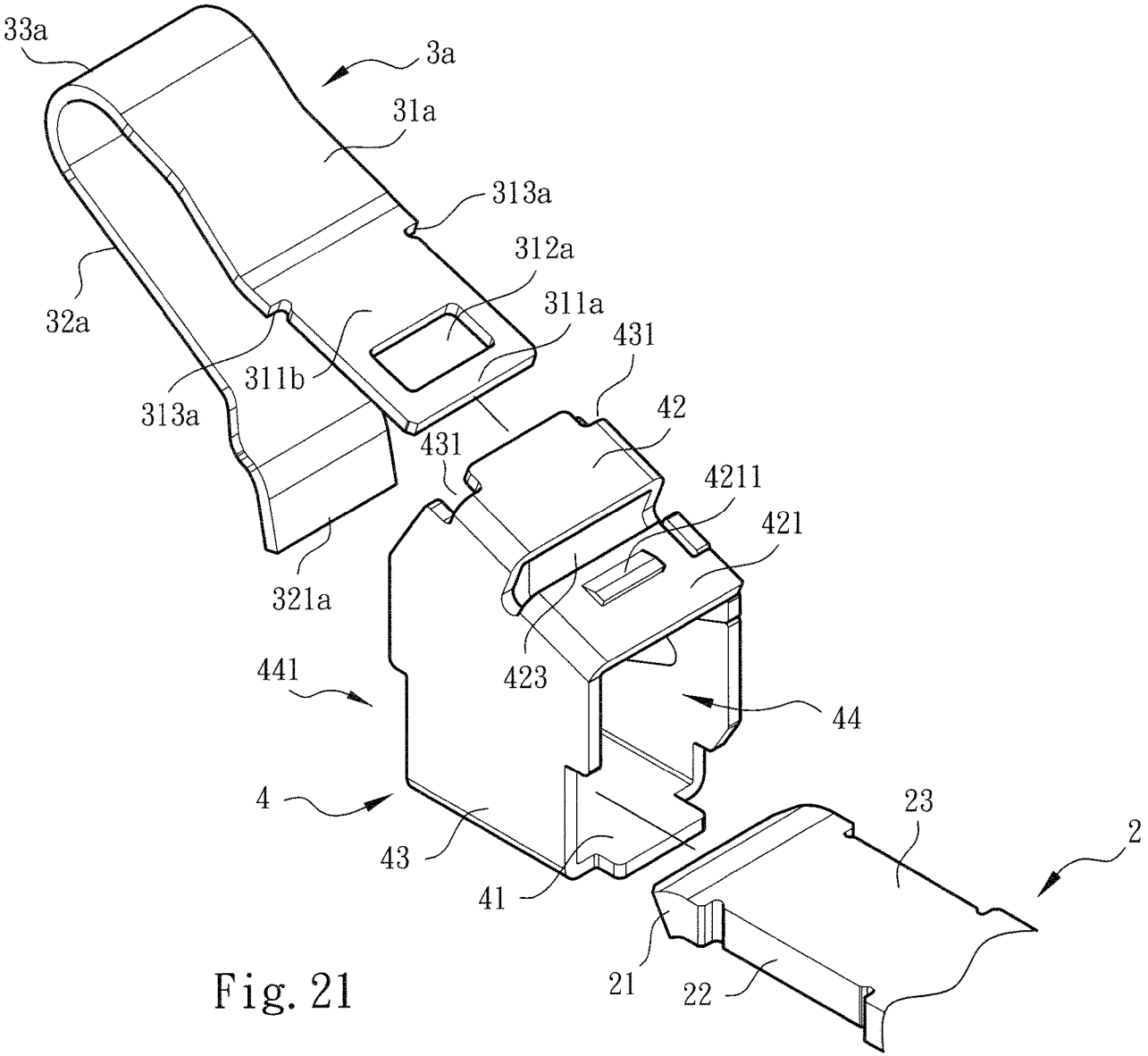
FIG. 21 is a perspective exploded view of the seventh embodiment of the present invention.
Figure 23:
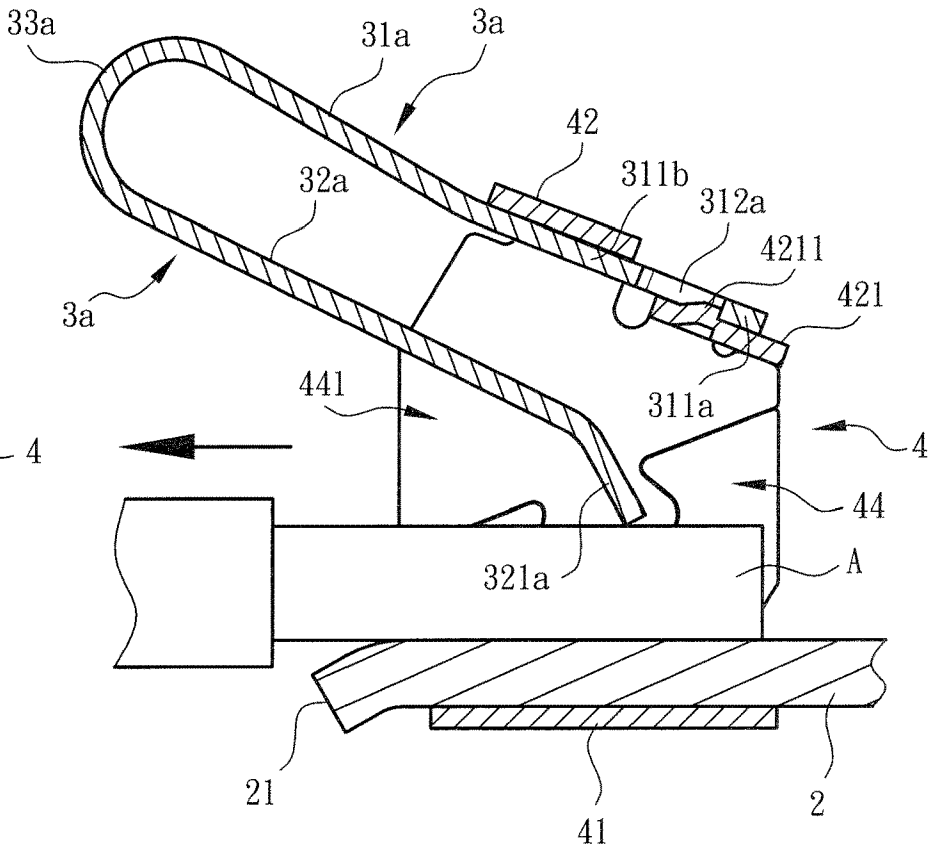
FIG. 23 is a sectional view according to FIG. 22, showing that the external conductive wire is fastened by the metal leaf spring and hindered from being extracted out of the terminal.
Figure 22:
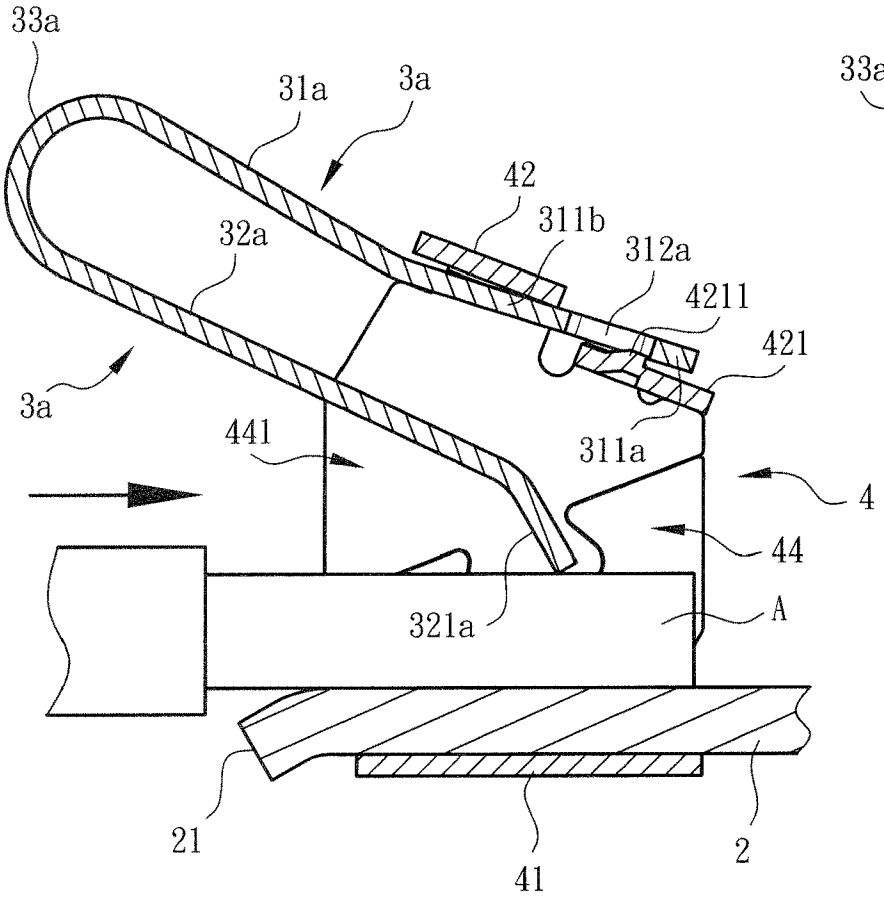
FIG. 22 is an operational sectional view of the seventh embodiment of the present invention, showing that the external conductive wire is plugged into the terminal to push the metal leaf spring.
Figure 24:
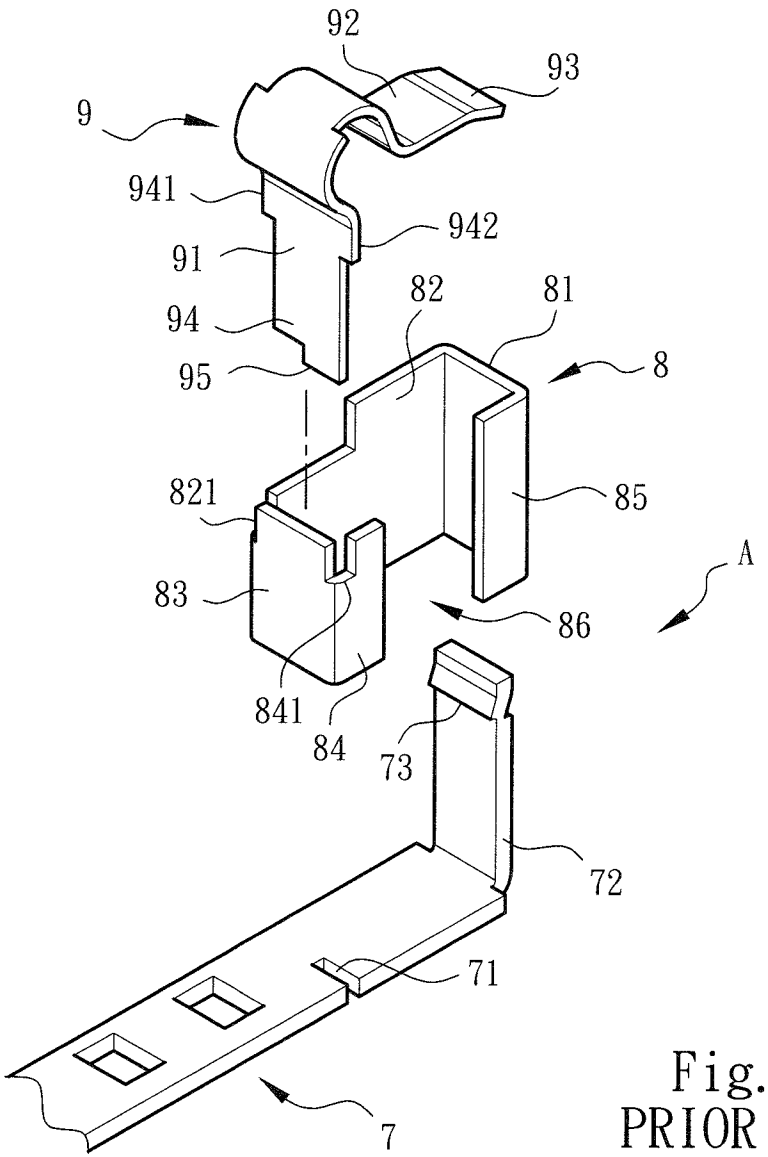
Fig. 24 PRIOR ART
FIG. 24 is a perspective exploded view of a conventional rail terminal.
Figure 26:
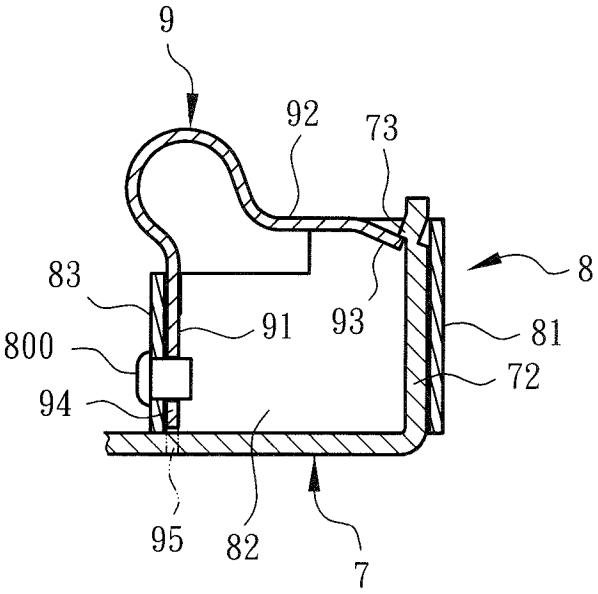
Fig. 26 PRIOR ART
FIG. 26 is a side sectional view of the conventional rail terminal according to FIG. 24, showing that the metal leaf spring and the protection member are connected by means of a fixing member.
Figure 25:
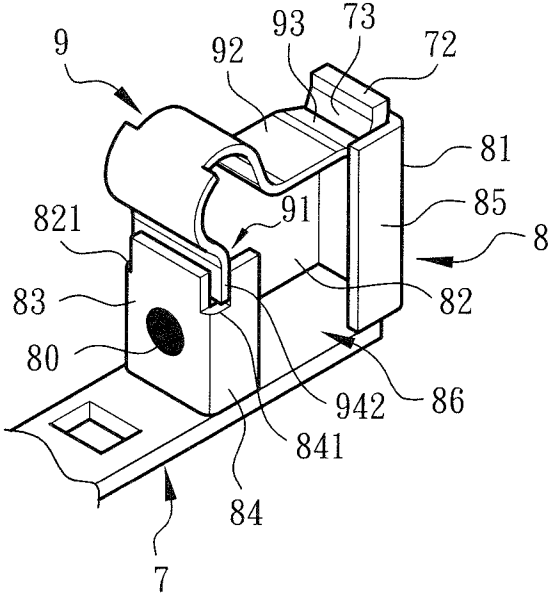
Fig. 25 PRIOR ART
FIG. 25 is a perspective assembled view of the conventional rail terminal according to FIG. 24, showing that the metal leaf spring and the protection member are connected by means of welding.

Please now refer to FIGS. 17 to 19. According to a sixth embodiment, the rail terminal assembling structure of the present invention includes a protection member 1*e* and a conductive plate 2 and metal leaf spring 3*a* identical to the conductive plate and metal leaf spring of the second embodiment. The protection member 1*e* has a contact side section lie and a connection side section 12*e* opposite to each other. Two lateral sections 13*e* are respectively disposed on two sides of the connection side section 12*e*. The lateral sections 13*e* extend from the two sides of the connection side section 12*e* to connect with two sides of the contact side section lie so as to define an assembling passage 14*e* passing through the protection member 1*e*. One end of the assembling passage 14*e* is a wire inlet 141*e*. A first locating section 131*e*, (such as a lateral notch) is formed at the junction between the connection side section 12*e* and each of the two lateral sections 13*e*. In addition, two second locating sections 132*e* are disposed at one end of the protection member 1*e* distal from the first locating sections 131*e* (the lateral notch). Moreover, an elastic locating section 121*e* is disposed on the connection side section 12*e*. The elastic locating section 121*e* protrudes toward the assembling passage 14*e*.

In a preferred embodiment, the second locating sections 132*e* are two lateral stop sections respectively disposed on the middles of the lateral sections 13*e*. The lateral stop sections are bent toward the connection side section 12*e*. In addition, a gap 15*e* is reserved between the second locating sections 132*e* (the lateral stop sections) and the connection side section 12*e*.

The conductive plate 2 is securely assembled and connected on the inner surface of the contact side section lie of the protection member 1*e* in the same manner as the first embodiment.

When assembled, after the conductive plate 2 is connected with the protection member 1*e*, the metal leaf spring 3*a* is extended into the assembling passage 14*e* with the first section 31*a* attached to the connection side section 12*e*. The second located section 311*a* of the first section 31*a* is directly passed through the gap 15*e* and the elastic locating section 121*e* (the elastic locating tongue section) is cooperatively extended into the insertion section 312*a*. The two first located sections 313*a* (the lateral protrusion sections) are respectively engaged with the two first locating sections 131*e* (the lateral notches). Accordingly, the first section 31*a* of the metal leaf spring 3*a* is securely connected with the connection side section 12*e* of the protection member 1*e* to locate the metal leaf spring 3*a*. Also, the end section 321*a* of the second section 32*a* of the metal leaf spring 3*a* abuts against the inner face 23 of the conductive plate 2.

In use, the external conductive wire A extends into the assembling passage 14*e* from one side near the first locating section 131*e* (the lateral notch). At this time, the conductive wire A first pushes the second section 32*a* of the metal leaf spring 3*a* to elastically compress and deform the elastic bight section 33*a*. After the conductive wire A passes through the end section 321*a*, under the elastic restoring force of the elastic bight section 33*a*, the end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

Please now refer to FIGS. 20 to 23. According to a seventh embodiment, the rail terminal assembling structure of the present invention includes a protection member 4 and a conductive plate 2 and metal leaf spring 3*a* identical to the conductive plate and metal leaf spring of the second embodiment. The protection member 4 has a contact side section 41 and a connection side section 42 opposite to each other. Two lateral sections 43 are respectively disposed on two sides of the connection side section 42. The lateral sections 43 extend from the two sides of the connection side section 42 to connect with two sides of the contact side section 41 so as to define an assembling passage 44 passing through the protection member 4. One end of the assembling passage 44 is a wire inlet 441. A first locating section 431, (such as a lateral notch) is formed at the junction between the connection side section 42 and each of the two lateral sections 43. In addition, a second locating sections 421 is disposed at one end of the protection member 4 distal from the first locating sections 431 (the lateral notch).

In a preferred embodiment, the second locating section 421 is a lateral bottom section connected between the edges of the two lateral sections 43. The lateral bottom section is positioned on the same side as the connection side section 42 and is lower than the connection side section 42. Accordingly, a lower gap 423 with a height difference is formed between the lateral bottom section and the connection side section 42. At least one protruding elastic locating section 4211 is disposed on the second locating section 421 (the lateral bottom section).

The conductive plate 2 is securely assembled and connected on the inner surface of the contact side section 41 of the protection member 4 in the same manner as the first embodiment. In this embodiment, the tail end of the first section 31*a* of the metal leaf spring is the second located section 311*a*. In addition, a subsidiary locating section 311*b* is defined or formed between the first located section 313*a* and the insertion section 312*a* of the metal leaf spring 3*a*.

When assembled, after the conductive plate 2 is connected with the protection member 4, the metal leaf spring 3*a* is extended into the assembling passage 44 with the first section 31*a* attached to the connection side section 42. The first section 31*a* is directly passed through the lower gap 423 and the elastic locating section 4211 is inserted in the insertion section 312*a*. The two first located sections 313*a* (the lateral protrusion sections) are respectively engaged with the two first locating sections 431 (the lateral notches). Accordingly, the subsidiary locating section 311*b* and the second located section 311*a* of the first section 31*a* of the metal leaf spring 3*a* is securely connected with the connection side section 42 and the second locating section 421 (the lateral bottom section) of the protection member 4 and to locate the metal leaf spring 3*a*. Also, the end section 321*a* of the second section 32*a* of the metal leaf spring 3*a* abuts against the inner face 23 of the conductive plate 2.

In use, the external conductive wire A extends into the assembling passage 44 from one side near the first locating section 431 (the lateral notch). At this time, the conductive wire A first pushes the second section 32*a* of the metal leaf spring 3*a* to elastically compress and deform the elastic bight section 33*a*. After the conductive wire A passes through the end section 321*a*, under the elastic restoring force of the elastic bight section 33*a*, the end section 321*a* of the second section 32*a* cooperates with the inner face 23 of the conductive plate 2 to together hold the conductive wire A and electrically connect therewith. In the case that the conductive wire A is pulled by an external force, the conductive wire A will drive the second section 32*a* to move in reverse direction. Under such circumstance, the second section 32*a* will gradually move toward the conductive wire A and fasten the conductive wire A to effectively hinder the conductive wire A from being loosened and extracted out.

That is, when the first section 31*a* and the subsidiary locating section 311*b* extend into the assembling passage 44 corresponding to the connection side section 42, the subsidiary locating section 311*b* will press and securely connect with the connection side section 42. Also, the first section 31*a* (or the second located section 311*a*) elastically pushes/presses the elastic locating section 4211 until the insertion section 312*a* reaches the elastic locating section 4211. At this time, the elastic locating section 4211 is elastically engaged into the insertion section 312*a* and cooperates with the second locating section 421 to secure the second located section 311*a* of the first section 31*a* of the metal leaf spring. Accordingly, the first section 31*a* of the metal leaf spring and the protection member 4 form a multi-portion locating system, whereby when an operator plugs the conductive wire A into and/or extracts the conductive wire A out of the terminal, the external action force of the operator is prevented from making the metal leaf spring 3*a* loosen or detach from the protection member 4.

Especially, the first section 31*a* of the U-shaped metal leaf spring 3*a* is connected with the inner surface of the preset connection side section 42 of the protection member 4, whereby the first section 31*a* of the metal leaf spring is respectively securely connected with the front and rear sides of the contact portion of the connection side section 42 and the end section 321*a* of the second section 32*a* of the metal leaf spring abuts against the conductive plate 2. When an operator plugs the conductive wire A into and/or extracts the conductive wire A out of the terminal, the metal leaf spring 3*a* (or the first section 31*a*) will displace in response to the external action force of the operator. The maximum displacement amount is limited within a movable range together defined by the assembling structure of the connection side section 42, the elastic locating section 4211 and the insertion section 312*a* and the second locating section 421 and the second located section 311*a* (three positions). (That is, the movable distance of the subsidiary locating section 311*b*, the second located section 311*a* and the insertion section 312*a* is limited or regulated within the allowable motional range together defined by the connection side section 42, the elastic locating section 4211 and the second locating section 421). Accordingly, a connection effect without easy loosening is set up between the protection member 4, the metal leaf spring 3*a* and the conductive plate 2.

Therefore, it can be realized that the assembling structure of the elastic locating section 4211 engaged in the insertion section 312*a* (in cooperation with the connection side section 42, and the second locating section 421) interrupts the extraction path of the metal leaf spring 3*a* (or the first section 31*a*). The metal leaf spring 3*a* (or the first section 31*a*) cannot be retreated out of the protection member 4 from the aforesaid allowable motional range unless an operator operates the elastic locating section 4211 to separate from the insertion section 312*a*.

In conclusion, in the rail terminal assembling structure of the present invention, the protection member and the metal leaf spring can be truly conveniently assembled with each other and more securely located. This improves the shortcoming of the conventional terminal assembling structure that the conductive plate is needed to help in assembling the metal leaf spring with the protection member. Moreover, after the protection member is assembled with the conductive plate, the wire plug-in direction can be adjusted in accordance with the required different angles. (For example, the angle can be changed as shown by the phantom lines of FIG. 1). Therefore, the external conductive wire can be plugged into the terminal by different angles. Accordingly, the rail terminal assembling structure of the present invention is novel, advanced and inventive.

The above embodiments are only used to illustrate the present invention, not intended to limit the scope thereof. Many modifications of the above embodiments can be made without departing from the spirit of the present invention.

What is claimed is:

1. A rail terminal assembling structure comprising:

a protection member composed of a contact side section, a connection side section opposite to the contact side section and two lateral sections disposed between the connection side section and the contact side section, the contact side section, the connection side section and the lateral sections together defining an assembling passage passing through the protection member, the assembling passage having a wire inlet, the protection member having a first locating section and a second locating section disposed at one end of the protection member distal from the first locating section, an elastic locating section being disposed between the first and second locating sections;

a conductive plate, an end section of the conductive plate extending into the assembling passage of the protection member and securely attaching to an inner surface of the contact side section; and a metal leaf spring having a first section, a second section and an elastic bight section connected between the first and second sections, whereby the metal leaf spring is a U-shaped member, the first section being connected with an inner surface of the connection side section of the protection member, a first located section being disposed on the first section of the metal leaf spring near the elastic bight section, in addition, a second located section being disposed on the first section in a position corresponding to the second locating section, an insertion section being disposed between the first and second located sections corresponding to the elastic locating section, whereby when the first section extends into the assembling passage corresponding to the connection side section until the insertion section reaches the elastic locating section, the elastic locating section is engaged into the insertion section and the first located section is securely assembled with the first locating section and the second locating section cooperatively secures the second located section of the first section of the metal leaf spring so that the metal leaf spring and the protection member are securely assembled with each other and the second section of the metal leaf spring extends in a direction to the contact side section and the conductive plate.

2. The rail terminal assembling structure as claimed in claim 1, wherein the insertion section has the form of a locating hole and the elastic locating section is a protruding elastic tongue section, whereby the first section elastically pushes/presses the elastic locating section and permits the elastic locating section to be elastically engaged into the insertion section, the second section of the metal leaf spring having an end section abutting against the conductive plate, a maximum displacement amount of the first section of the metal leaf spring in response to an external action force being limited within a movable range together defined by an assembling structure of the elastic locating section and the insertion section and the second locating section and the second located section.

3. The rail terminal assembling structure as claimed in claim 2, wherein the first locating section is lateral notches and the first located section is outward expanding lateral protrusion sections disposed on two sides of the first section near a middle section, the second located section of the metal leaf spring being disposed at a tail end of the first section, a tail end of the second section being formed with an arched end section bent toward the contact side section, the conductive plate being respectively formed with lateral recesses near two lateral sides of two end sections, the lateral recesses being fittable with a portion of the two lateral sections of the protection member in adjacency to the contact side section with the conductive plate attached to the inner side of the contact side section, whereby the protection member is located and hindered from moving in an axial direction of the conductive plate, a lateral surface of the conductive plate distal from the contact side section forming an inner face, the two end sections of the conductive plate being respectively formed with arched edges extending in a direction away from the assembling passage.

4. The rail terminal assembling structure as claimed in claim 3, wherein the second locating section is a stop plate downward bent from an edge of the connection side section toward the assembling passage, the stop plate being formed with a perforation on one side near the connection side section, the second locating section serving to stop the tail end of the first section of the metal leaf spring to make the second located section inserted into the perforation, the first located section being securely connected with the first locating section, the first locating section, the elastic locating section and the perforation of the second locating section being connected with the first located section, the insertion section and the second located section, whereby the first section of the metal leaf spring and the connection side section of the protection member form a multi-portion locating system.

5. The rail terminal assembling structure as claimed in claim 3, wherein a middle section of the second locating section is punched and formed with an upward protruding elastic tongue section protruding toward the connection side section, a gap being reserved between the upward protruding elastic tongue section and the connection side section, two lateral stop sections being respectively disposed on the two lateral sections near an edge of the second locating section, the lateral stop sections being bent toward the assembling passage, the two lateral stop sections being positioned on two lateral outer sides of the second locating section, the second locating section serving to stop the tail end of the first section of the metal leaf spring and the tail end of the first section or the second located section being directly inserted in the gap between the upward protruding elastic tongue section and the connection side section, the first located section being securely connected with the first locating section, the first locating section, the elastic locating section and the upward protruding elastic tongue section of the second locating section being connected with the first located section, the insertion section and the second located section, whereby the first section of the metal leaf spring and the connection side section of the protection member form a multi-portion locating system.

6. The rail terminal assembling structure as claimed in claim 3, wherein the second locating section is a bent plate extending into the assembling passage and bent toward the first locating section, two lateral stop sections being respectively disposed on the two lateral sections near a lateral edge of the second locating section, the lateral stop sections being bent toward the assembling passage, the lateral stop sections respectively abutting against a bottom side of the second locating section, the second locating section holding the tail end of the first section of the metal leaf spring or the second located section, the first located section being securely connected with the first locating section.

7. The rail terminal assembling structure as claimed in claim 3, wherein two lateral stop sections are respectively disposed on the two lateral sections of the second locating section on a lateral edge distal from the first locating section, the lateral stop sections being bent toward the assembling passage, a gap being reserved between the second locating section and the connection side section, the second located section of the first section directly passing through the gap, the first located section being connected with the first locating section.

8. The rail terminal assembling structure as claimed in claim 3, wherein two lateral stop sections are disposed on the two lateral sections of the second locating section, the lateral stop sections being transversely bent toward the assembling passage, a gap being reserved between the second locating section and the connection side section, the second located section of the first section directly passing through the gap, the first located section being connected with the first locating section.

9. The rail terminal assembling structure as claimed in claim 3, wherein two lateral stop sections are disposed on middle sections of the two lateral sections of the second locating section, the lateral stop sections being bent toward the connection side section, a gap being reserved between the second locating section and the connection side section, the second located section of the first section directly passing through the gap, the first located section being connected with the first locating section.

10. The rail terminal assembling structure as claimed in claim 3, wherein the second locating section is a lateral bottom section connected between edges of the two lateral sections, the lateral bottom section being positioned on the same side as the connection side section and lower than the connection side section, whereby a lower gap with a height difference is formed between the lateral bottom section and the connection side section, the elastic locating section being disposed on the lateral bottom section, the tail end of the first section of the metal leaf spring being the second located section, a subsidiary locating section being formed between the first located section and the insertion section of the metal leaf spring, the first section directly passing through the lower gap, the first located section being connected with the first locating section, whereby the subsidiary locating section and the second located section of the first section of the metal leaf spring can be connected with the connection side section and the second locating section of the protection member, the subsidiary locating section serving to press and securely connect with the connection side section, the second locating section cooperatively securing the second located section, whereby a maximum displacement amount of the metal leaf spring in response to the external action force is limited within a movable range together defined by an assembling structure of the connection side section, the elastic locating section, the insertion section, the second locating section and the second located section, that is, the movable distance of the subsidiary locating section, the second located section and the insertion section is regulated within an allowable motional range together defined by the connection side section, the elastic locating section and the second locating section.

11. The rail terminal assembling structure as claimed in claim 2, wherein the second locating section is a stop plate downward bent from an edge of the connection side section toward the assembling passage, the stop plate being formed with a perforation on one side near the connection side section.

12. The rail terminal assembling structure as claimed in claim 2, wherein a middle section of the second locating section is punched and formed with an upward protruding elastic tongue section protruding toward the connection side section, a gap being reserved between the upward protruding elastic tongue section and the connection side section.

13. The rail terminal assembling structure as claimed in claim 2, wherein the second locating section is a bent plate extending into the assembling passage and bent toward the first locating section, two lateral stop sections being respectively disposed on the two lateral sections near a lateral edge of the second locating section, the lateral stop sections being bent toward the assembling passage, the lateral stop sections respectively abutting against a bottom side of the second locating section.

14. The rail terminal assembling structure as claimed in claim 2, wherein two lateral stop sections are respectively disposed on the two lateral sections of the second locating section on a lateral edge distal from the first locating section, the lateral stop sections being bent toward the assembling passage, a gap being reserved between the second locating section and the connection side section.

15. The rail terminal assembling structure as claimed in claim 2, wherein two lateral stop sections are disposed on the two lateral sections of the second locating section, the lateral stop sections being transversely bent toward the assembling passage, a gap being reserved between the second locating section and the connection side section.

16. The rail terminal assembling structure as claimed in claim 2, wherein two lateral stop sections are disposed on middle sections of the two lateral sections of the second locating section, the lateral stop sections being bent toward the connection side section, a gap being reserved between the second locating section and the connection side section.

17. The rail terminal assembling structure as claimed in claim 2, wherein the second locating section is a lateral bottom section connected between edges of the two lateral sections, the lateral bottom section being positioned on the same side as the connection side section and lower than the connection side section, whereby a lower gap with a height difference is formed between the lateral bottom section and the connection side section, the elastic locating section being disposed on the lateral bottom section.

18. The rail terminal assembling structure as claimed in claim 1, wherein the first locating section is lateral notches and the first located section is outward expanding lateral protrusion sections disposed on two sides of the first section near a middle section, the second located section of the metal leaf spring being disposed at a tail end of the first section, a tail end of the second section being formed with an arched end section bent toward the contact side section, the conductive plate being respectively formed with lateral recesses near two lateral sides of two end sections, the lateral recesses being fittable with a portion of the two lateral sections of the protection member in adjacency to the contact side section with the conductive plate attached to the inner side of the contact side section, whereby the protection member is located and hindered from moving in an axial direction of the conductive plate, a lateral surface of the conductive plate distal from the contact side section forming an inner face, the two end sections of the conductive plate being respectively formed with arched edges extending in a direction away from the assembling passage.

19. The rail terminal assembling structure as claimed in claim 18, wherein the second locating section is a stop plate downward bent from an edge of the connection side section toward the assembling passage, the stop plate being formed with a perforation on one side near the connection side section, the second locating section serving to stop the tail end of the first section of the metal leaf spring to make the second located section inserted into the perforation, the first located section being securely connected with the first locating section, the first locating section, the elastic locating section and the perforation of the second locating section being connected with the first located section, the insertion section and the second located section, whereby the first section of the metal leaf spring and the connection side section of the protection member form a multi-portion locating system.

20. The rail terminal assembling structure as claimed in claim 18, wherein a middle section of the second locating section is punched and formed with an upward protruding elastic tongue section protruding toward the connection side section, a gap being reserved between the upward protruding elastic tongue section and the connection side section, two lateral stop sections being respectively disposed on the two lateral sections near an edge of the second locating section, the lateral stop sections being bent toward the assembling passage, the two lateral stop sections being positioned on two lateral outer sides of the second locating section, the second locating section serving to stop the tail end of the first section of the metal leaf spring and the tail end of the first section or the second located section being directly inserted in the gap between the upward protruding elastic tongue section and the connection side section, the first located section being securely connected with the first locating section, the first locating section, the elastic locating section and the upward protruding elastic tongue section of the second locating section being connected with the first located section, the insertion section and the second located section, whereby the first section of the metal leaf spring and the connection side section of the protection member form a multi-portion locating system.

21. The rail terminal assembling structure as claimed in claim 18, wherein the second locating section is a bent plate extending into the assembling passage and bent toward the first locating section, two lateral stop sections being respectively disposed on the two lateral sections near a lateral edge of the second locating section, the lateral stop sections being bent toward the assembling passage, the lateral stop sections respectively abutting against a bottom side of the second locating section, the second locating section holding the tail end of the first section of the metal leaf spring or the second located section, the first located section being securely connected with the first locating section.

22. The rail terminal assembling structure as claimed in claim 18, wherein two lateral stop sections are respectively disposed on the two lateral sections of the second locating section on a lateral edge distal from the first locating section, the lateral stop sections being bent toward the assembling passage, a gap being reserved between the second locating section and the connection side section, the second located section of the first section directly passing through the gap, the first located section being connected with the first locating section.

23. The rail terminal assembling structure as claimed in claim 18, wherein two lateral stop sections are disposed on the two lateral sections of the second locating section, the lateral stop sections being transversely bent toward the assembling passage, a gap being reserved between the second locating section and the connection side section, the second located section of the first section directly passing through the gap, the first located section being connected with the first locating section.

24. The rail terminal assembling structure as claimed in claim 18, wherein two lateral stop sections are disposed on middle sections of the two lateral sections of the second locating section, the lateral stop sections being bent toward the connection side section, a gap being reserved between the second locating section and the connection side section, the second located section of the first section directly passing through the gap, the first located section being connected with the first locating section.

25. The rail terminal assembling structure as claimed in claim 18, wherein the second locating section is a lateral bottom section connected between edges of the two lateral sections, the lateral bottom section being positioned on the same side as the connection side section and lower than the connection side section, whereby a lower gap with a height difference is formed between the lateral bottom section and the connection side section, the elastic locating section being disposed on the lateral bottom section, the tail end of the first section of the metal leaf spring being the second located section, a subsidiary locating section being formed between the first located section and the insertion section of the metal leaf spring, the first section directly passing through the lower gap, the first located section being connected with the first locating section, whereby the subsidiary locating section and the second located section of the first section of the metal leaf spring can be connected with the connection side section and the second locating section of the protection member, the subsidiary locating section serving to press and securely connect with the connection side section, the second locating section cooperatively securing the second located section, whereby a maximum displacement amount of the metal leaf spring in response to an external action force is limited within a movable range together defined by the assembling structure of the connection side section, the elastic locating section, the insertion section, the second locating section and the second located section, that is, the movable distance of the subsidiary locating section, the second located section and the insertion section is regulated within an allowable motional range together defined by the connection side section, the elastic locating section and the second locating section.

26. The rail terminal assembling structure as claimed in claim 1, wherein the second locating section is a stop plate downward bent from an edge of the connection side section toward the assembling passage, the stop plate being formed with a perforation on one side near the connection side section.

27. The rail terminal assembling structure as claimed in claim 1, wherein a middle section of the second locating section is punched and formed with an upward protruding elastic tongue section protruding toward the connection side section, a gap being reserved between the upward protruding elastic tongue section and the connection side section.

28. The rail terminal assembling structure as claimed in claim 1, wherein the second locating section is a bent plate extending into the assembling passage and bent toward the first locating section, two lateral stop sections being respectively disposed on the two lateral sections near a lateral edge of the second locating section, the lateral stop sections being bent toward the assembling passage, the lateral stop sections respectively abutting against a bottom side of the second locating section.

29. The rail terminal assembling structure as claimed in claim 1, wherein two lateral stop sections are respectively disposed on the two lateral sections of the second locating section on a lateral edge distal from the first locating section, the lateral stop sections being bent toward the assembling passage, a gap being reserved between the second locating section and the connection side section.

30. The rail terminal assembling structure as claimed in claim 1, wherein two lateral stop sections are disposed on the two lateral sections of the second locating section, the lateral stop sections being transversely bent toward the assembling passage, a gap being reserved between the second locating section and the connection side section.

31. The rail terminal assembling structure as claimed in claim 1, wherein two lateral stop sections are disposed on middle sections of the two lateral sections of the second locating section, the lateral stop sections being bent toward the connection side section, a gap being reserved between the second locating section and the connection side section.

32. The rail terminal assembling structure as claimed in claim 1, wherein the second locating section is a lateral bottom section connected between edges of the two lateral sections, the lateral bottom section being positioned on the same side as the connection side section and lower than the connection side section, whereby a lower gap with a height difference is formed between the lateral bottom section and the connection side section, the elastic locating section being disposed on the lateral bottom section.

* * * * *